US005604568A

United States Patent [19]

Iwama

[11] Patent Number: 5,604,568

[45] Date of Patent: Feb. 18, 1997

[54] IMAGE FORMING APPARATUS

[75] Inventor: Ryouichi Iwama, Kawasaki, Japan

[73] Assignee: Fujitsu Limited, Kawasaki, Japan

[21] Appl. No.: 423,931

[22] Filed: Apr. 18, 1995

[30] Foreign Application Priority Data

May 16, 1994 [JP] Japan ..... 6-101103

[51] Int. Cl.[6] ..... G03G 15/00

[52] U.S. Cl. ..... 399/215; 347/112; 347/138; 347/152; 399/68

[58] Field of Search ..... 355/200, 210, 355/271, 282, 269, 270, 277, 202, 285; 347/112, 129, 130, 138, 152, 155, 156; 400/55, 320

[56] References Cited

U.S. PATENT DOCUMENTS

| | | | |
|---|---|---|---|
| 4,435,068 | 3/1984 | Landa | 355/271 X |
| 4,754,304 | 6/1988 | Ohashi et al. | 355/270 |
| 4,845,519 | 7/1989 | Fuse | 355/212 X |
| 4,897,677 | 1/1990 | Lai | 355/211 X |
| 5,196,870 | 3/1993 | Itoh et al. | 355/212 X |
| 5,216,453 | 6/1993 | Itoh | 355/200 X |
| 5,459,503 | 10/1995 | Ishii | 347/152 |
| 5,461,463 | 1/1996 | Iwama | 355/210 |
| 5,488,452 | 1/1996 | Iwama | 355/202 |
| 5,508,666 | 4/1996 | Masuda et al. | 355/210 X |

FOREIGN PATENT DOCUMENTS

| | | |
|---|---|---|
| 56-77167 | 6/1981 | Japan . |
| 61-152463 | 7/1986 | Japan . |
| 61-145649 | 9/1986 | Japan . |

*Primary Examiner*—Matthew S. Smith

*Attorney, Agent, or Firm*—Armstrong, Westerman, Hattori, McLeland & Naughton

[57] ABSTRACT

A conveying unit conveys a recording sheet in a sheet conveying direction. A carriage includes a processing unit including an image carrier which is rotated about a rotational axis parallel to the sheet conveying direction. The processing unit forms a latent image on the image carrier by electrically charging and developing the latent image so as to produce a developed image. A transfer unit transfers the developed image on the image carrier to the recording sheet as a result of inserting the recording paper between the image carrier and said transfer unit as the carriage moves on the recording sheet in a carriage moving direction. A fixing unit fixes the developed image onto the recording sheet, and a supporting member rotatably supports the processing unit and the fixing unit. A moving unit moves the carriage in the carriage moving direction which is perpendicular to the sheet conveying direction. A retreating mechanism rotates the processing unit and the fixing unit so as to remove the image carrier and the fixing unit from the transfer unit.

10 Claims, 13 Drawing Sheets

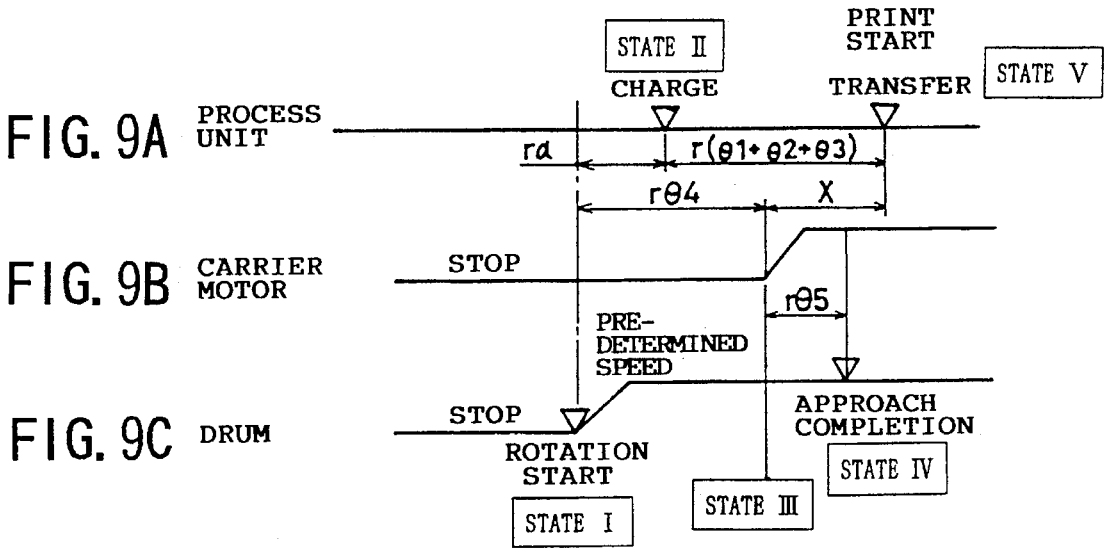
FIG. 9A
PROCESS UNIT
STATE II
CHARGE
PRINT START
TRANSFER
STATE V
rα
r(θ1+θ2+θ3)
rθ4
X
FIG. 9B
CARRIER MOTOR
STOP
rθ5
PRE-DETERMINED SPEED
FIG. 9C
DRUM
STOP
ROTATION START
APPROACH COMPLETION
STATE IV
STATE III
STATE I
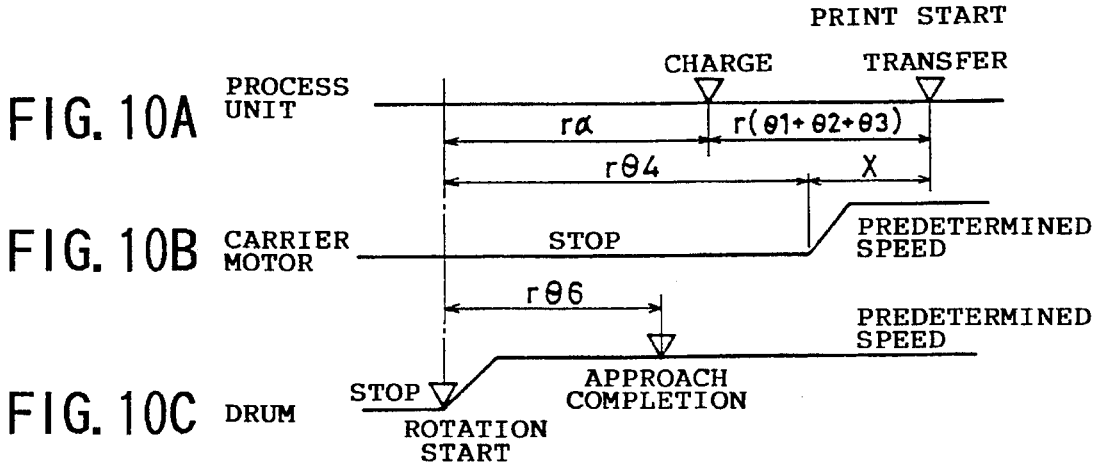
PRINT START
CHARGE
TRANSFER
FIG. 10A
PROCESS UNIT
rα
r(θ1+θ2+θ3)
rθ4
X
FIG. 10B
CARRIER MOTOR
STOP
PREDETERMINED SPEED
rθ6
PREDETERMINED SPEED
FIG. 10C
DRUM
STOP
APPROACH COMPLETION
ROTATION START

IMAGE FORMING APPARATUS

BACKGROUND OF THE INVENTION

1. Field of the Invention

The present invention relates to an image forming apparatus which prints an image as a result of forming a latent image on a recording drum and developing the latent image using toner.

Recently, electrophotographic printing apparatuses (printers) are becoming widespread for printing an image on a recording paper sheet. In such apparatuses, a latent image is formed on a recording drum, the latent image is then developed using toner to obtain a toner image, the toner image is transferred to a recording paper sheet, and the thus-transferred image is then fixed on the paper sheet. Responding to a demand to miniaturize the apparatuses, serial-type apparatuses are being proposed which apparatuses print a relevant image one line at a time, each line being a line extending along a width direction of a recording paper sheet. Apparatuses of this type for personal use having further miniaturization and cost reduction are demanded.

2. Related Art

Serial-type printers include wire dot printers, thermal printers, and electrophotographic printers.

In each of the wire dot printers and thermal printers, a print head is mounted on a carriage which moves along a direction perpendicular to a recording paper sheet conveying direction. The print head approaches a carried recording paper sheet, and then, performs a printing operation as the carriage moves.

In such a printer, a print head retreating mechanism is provided for preventing the print head and/or a recording paper sheet from jamming a paper sheet passing space. A generally known structure of the print head retreating mechanism includes a motor or a solenoid to move a guide shaft guiding movement of the carriage. As a result of the guide shaft being moved by the motor or solenoid, the print head retreats from the paper sheet passing space.

Alternatively, a print part retreating mechanism for print part retreating is applied to electrophotographic page printers. This print part retreating mechanism causes a transfer roller and a fixing roller facing an image carrying body (recording drum) to retreat after a printing operation has been finished. Thus, the image carrying body is prevented from being adversely affected (being corroded by contaminating components) from a transfer roller. Further, incomplete printing and afterimage phenomena are prevented. Further, the fixing roller retreating mainly prevents a recording paper sheet from jamming the paper sheet passing space.

With reference to FIGS. 1A and 1B, a serial-type electrophotographic printer in the related art will now be described. FIG. 1A shows a plan view and FIG. 1B shows a front elevational A—A (in FIG. 1A) sectional view. A reference numeral LE shown in the accompanying drawings including FIG. 1B shows the left edge of a recording paper sheet. In the serial-type electrophotographic printer $\mathbf{11}_A$, a carriage 12 consists of a process unit 13 and fixing unit 14, is guided by a shaft 15, and is driven by a driving motor 16 through a belt 16*a*. Thus, the carriage 12 moves above a transfer unit (print platen) 17 in a main scan direction perpendicular to a recording paper sheet conveying direction. A conveying roller 18 is provided in the rear of the carriage 12 as shown in FIG. 1A, and another conveying roller (not shown in the figures) is provided in front of the carriage 12. These conveying rollers convey a recording paper sheet 19 between the transfer unit 17 and the carriage 12 as shown in FIG. 1B.

In the process unit 13, an image carrying body 21 is rotated at a rotation speed such that a circumferential speed of the body 21 is the same as a movement speed of the carriage 12. A surface of the body 21 is uniformly charged by a charger 22 and a exposure unit 23 forms an electrostatic latent image on the surface of the body 21. The electrostatic latent image is developed to be a visible toner image as a result of toner 25 being supplied by a developer 24. The toner image thus formed on the body 21 is transferred to the recording paper sheet 19 by the transfer unit 17 which faces the body 21 via the recording paper sheet 19. After that, toner remaining on the body 21 is removed by a cleaner 27.

The thus-cleaned surface of the body 21 is again charged by the charger 22 and then a similar printing process is repeated. As the printing process is being thus repeated, the carriage 12 moves from the left end to the right end (in the main scan direction) of the recording paper sheet 19 as shown in FIG. 1B. Thus, a predetermined length of image part is printed. After that, the recording paper sheet 19 is forward moved a predetermined length (in the recording paper sheet conveying direction, from the bottom to the top in FIG. 1A) and the carriage 12 is moved from the right side to the left side in FIG. 1B returned to a predetermined position (a home position). Then, the carriage 12 is again moved in the main scan direction and then a similar printing operation is repeated.

The image transfer operation performed through the transfer unit 17 is performed in a state in which a predetermined electric potential is applied between the transfer unit 17 and the image carrying body 21.

The fixing unit 14 is provided with a fixing roller 28 and a heater 29 provided in proximity to the fixing roller 28. A pressure is applied to the recording paper sheet 19 by the fixing roller 28. The fixing unit 14 also consists of a silicon oil coating unit 30 provided adjacent to the fixing roller 28 which supplies silicon oil to the fixing roller 28 so that toner is prevented from adhering to the fixing roller 28. The fixing roller 28 is previously heated to a predetermined temperature before the process unit 13 performs the printing operation. A temperature of the fixing roller 28 is detected by a temperature detector such as a thermistor and is controlled while the process unit 13 is performing the printing operation. The fixing unit 14 moves together with the process unit 13 and fixes an image part which has been printed by the process unit 13.

With regard to FIGS. 2A, 2B and 2C, another sort of serial-type electrophotographic printer will now be described. FIG. 2A shows a plan view, FIG. 2B shows a front elevational A—A (in FIG. 2A) sectional view, and FIG. 2C shows a left-side elevational B—B (in FIG. 2A) sectional view. The serial-type electrophotographic printer $\mathbf{11}_B$ has a structure similar to that of the printer $\mathbf{11}_A$ shown in FIGS. 1A and 1B. However, the carriage 12 is guided by shafts 15*a* and 15*b*, and each of the image carrying body 21 and fixing roller 28 has a respective one of pinion gears 21*a* and 28*b* provided at one end of a rotation shaft thereof as shown in FIG. 2B. Further a rack gear 31 is provided which extends along the main scan direction in which the carriage 21 moves. Each of the pinion gears 21*a* and 28*b* engages with the rack gear 31.

The engagement between each of the pinion gears 21*a* and 28*b* and the rack gear 31 causes each of the image carrying body 21 and fixing roller 28 to be rotated as the carriage 12 moves in the main scan direction. Rotation speeds of the rotation of the image carrying body 21 and fixing roller 28 are ones such that respective circumferential speeds thereof are the same as a movement speed of the carriage 12.

Other than the above-described printers in the related art, another sort of serial-type electrophotographic printer is known. In this printer, no unit such as the fixing unit 14 is provided. Instead, a fixing unit having a length longer than a width of a recording paper sheet is provided in front (in the recording paper sheet conveying direction) of the carriage 12. A serial printer having the above-mentioned structure and also having a further structure is also known. The further structure is one, for example, in which a differential mechanism is inserted between the carriage and image carrying body, and a wire and pulleys are used in driving the carriage and image carrying body. In the further structure, rotation of the image carrying body is started when the carriage is located at the home position, and movement of the carriage is started when the image carrying body is rotated a predetermined rotation angle.

Structures of serial-type electrophotographic printers such as those described above are effective to miniaturize the printers. However, if a mechanism such as the above-described print head retreating mechanism or the above-described print part retreating mechanism is provided in such structures of the serial-type electrophotographic printer for the same purpose, the outward dimensions of the printer are enlarged and thus the costs increase.

Further, if a structure of a serial-type electrophotographic printer such as that in which only the process unit is provided in the carriage and the wire and pulleys are used to rotate the image carrying body before the actual printing operation starts is used, other problems may occur. That is, slipping may occur between the wire and pulleys so that it is difficult to accurately control the rotation angle of the image carrying body. If a rack gear and pinion gears are used instead of the wire and pulleys, this problem may be eliminated. However, in the case using the rack and pinion gears, an addition of an extra distance to the rack gear is necessary in order to rotate the image carrying body before the carriage reaches a printing starting position. Thus, the outward dimensions of the printer are enlarged.

Further, the structures of the printers $\mathbf{11}_A$ and $\mathbf{11}_B$ shown in FIGS. 1A, 1B, 2A, 2B and 2C are effective to miniaturize the outward dimensions of the printers because the fixing unit is contained in the carriage. However, it is necessary that each of the circumferential speeds of the body 21 and fixing unit 28 is the same as the moving speed of the carriage 21 on the recording paper sheet 19 while the printing operation is being performed on the recording paper sheet 19. Otherwise, an image to be printed on the recording paper sheet 19 may be degraded. However, in the structure shown in FIGS. 1A and 1B, due to a variation in friction resistance between the recording paper sheet and each of the body 21 and fixing unit 28, it is difficult to cause each of the circumferential speeds of the body 21 and fixing unit 28 to be the same as the moving speed of the carriage 21 on the recording paper sheet 19. The structure shown in FIGS. 2A, 2B and 2C may eliminate this problem. However, in the case using the rack and pinion gears, as mentioned above, the addition of an extra distance to the rack gear is necessary in order to rotate the image carrying body before the carriage reaches a printing starting position. Thus, the outward dimensions of the printer are enlarged.

Further, in each of structures such as those shown in FIGS. 1A, 1B, 2A, 2B and 2C, another problem may occur. That is, if unfixed toner is unexpectedly transferred to a part, other than the recording paper sheet, such as the transfer unit in the printer, a rear side of a subsequently supplied recording paper sheet may be stained. Further, if the thus-transferred toner is then transferred to the fixing roller, the thus-transferred toner is then unexpectedly transferred to the recording paper sheet in the subsequent printing operation.

SUMMARY OF THE INVENTION

An object of the present invention is to provide an image forming apparatus in which a fixing unit is included in a carriage whereby it is possible to miniaturize the outward dimensions of the apparatus.

In order to achieve this object, a recording drum and a fixing roller are rotatably supported and thus the drum (image carrier) and fixing roller can retreat from a transfer unit if necessary. Therefore, miniaturization of a printer can be achieved.

Further, by providing a retreating mechanism including driving means, transmitting means and engaging means, the retreating of the drum and fixing roller can be easily realized.

Further, by using the driving means also for rotating the recording drum, a cost reduction can be achieved.

Further, by rotating the drum a predetermined rotation angle before the carriage moves from a printing starting position, and also by rotating the drum at a circumferential speed the same as a carriage moving speed, it is possible to start printing at an accurate position and to reduce a run-up distance required before starting actual printing. Thus, the cost can be reduced.

Further, a voltage of a polarity reverse to a polarity of changed toner (developing substance) is applied to a developing roller wherein the polarity of the applied voltage is switched when the carriage is in a retreating state. Remaining toner on the recording drum can be collected by the developing roller. Thus, printing quality can be improved without using a special cleaner.

Further, by determining a diameter of the recording drum such that one rotation of the drum results in printing within a maximum printing width of a recording paper sheet, the above-described toner collection by the developing roller can be performed every one rotation of the drum. Thus, the printing quality can be improved without using the special cleaner.

Further, by providing detecting means for detecting an edge of the recording paper sheet on the carriage, it is possible to reduce a run-up distance of the carriage required before performing an actual printing operation. Thus, the printer can be miniaturized. Further, it is also possible to prevent toner from being transferred to something other than the recording paper sheet.

Further, by providing a cleaning member for automatically cleaning the detecting means every stroke of carriage movement, the detecting means can be maintained in a cleaned condition. Thus, an accurate detecting operation can be ensured.

Further, by stopping movement of the carriage for a predetermined time, after a starting edge of the recording paper sheet, while the recording drum is being rotated, it is possible to control an edge margin obtained on the recording paper sheet after printing is performed thereon and also to reduce the carriage run-up distance. Thus, the printer can be miniaturized.

Other objects and further features of the present invention will become more apparent from the following detailed description when read in conjunction with the accompanying drawings.

BRIEF DESCRIPTION OF THE DRAWINGS

FIGS. 9A, 9B and 9C show a timing chart of a printing operation of the printer shown in FIGS. 3A and 3B;

FIGS. 10A, 10B and 10C show a timing chart of an operation of the printer shown in FIGS. 3A and 3B when a carriage is located in a home position:

DESCRIPTION OF THE PREFERRED EMBODIMENTS

Figure 1A:
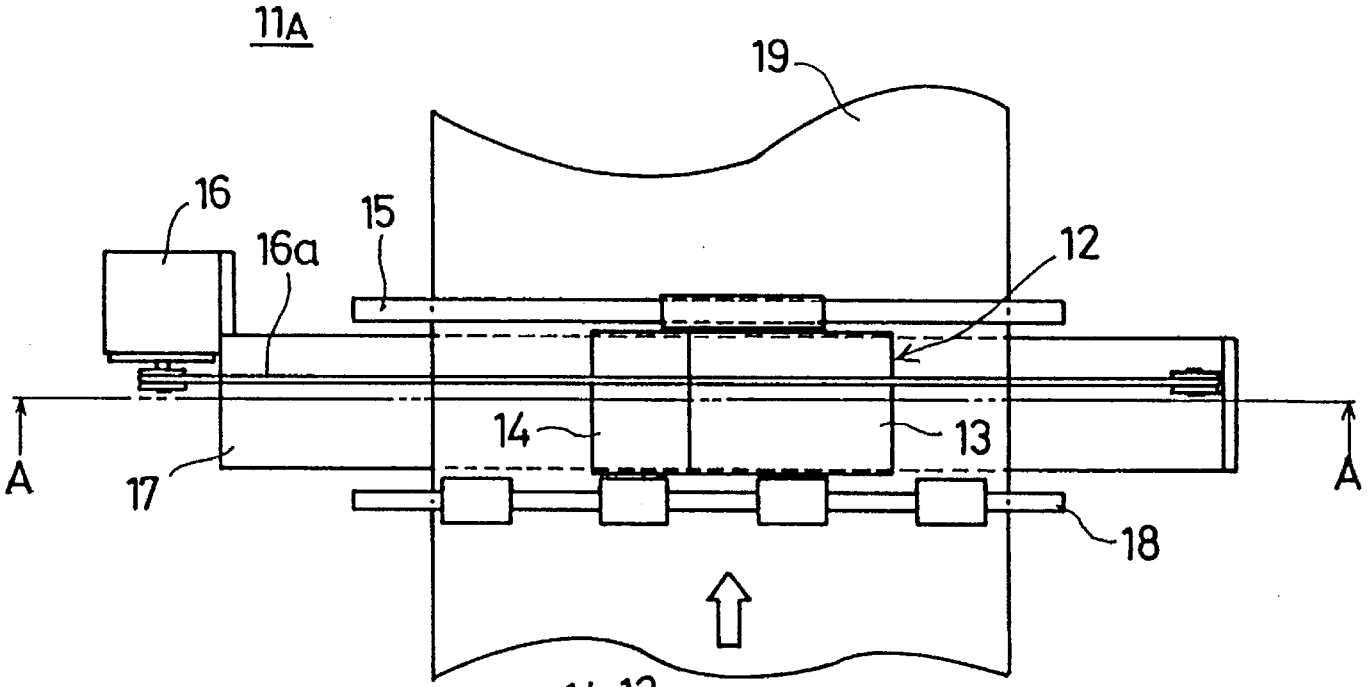
FIGS. 1A and 1B show a structure of a serial-type electrophotographic printer in the related art.
Figure 1B:
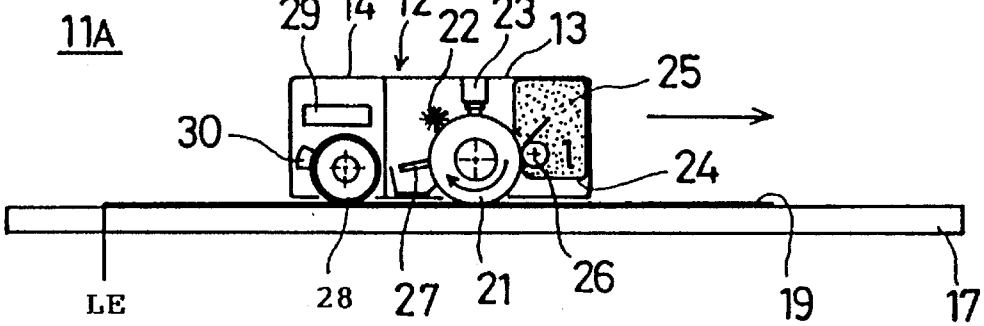
Figure 2A:
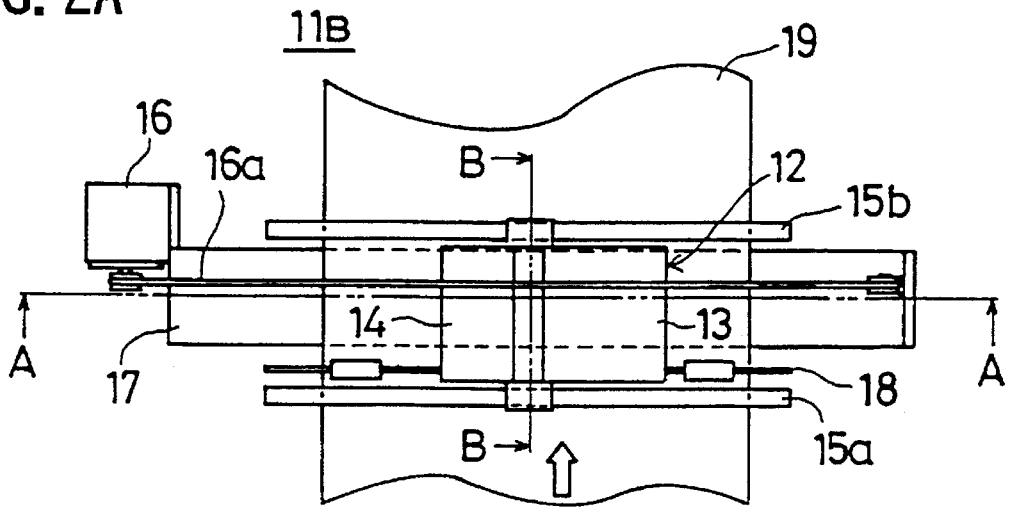
FIGS. 2A, 2B and 2C show a structure of another serial-type electrophotographic printer in the related art.
Figure 2B:
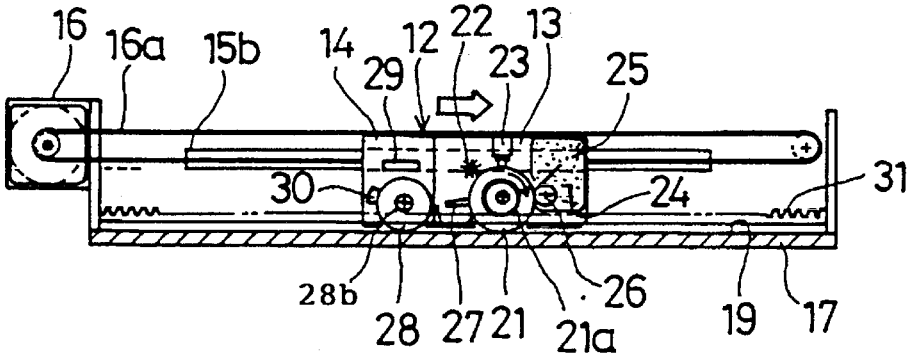
Figure 2C:
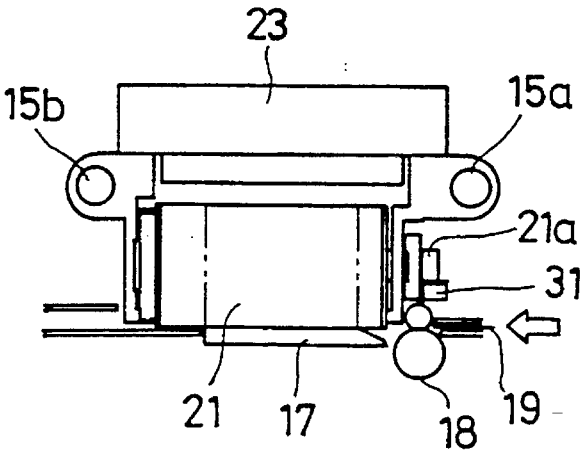
Figure 3A:
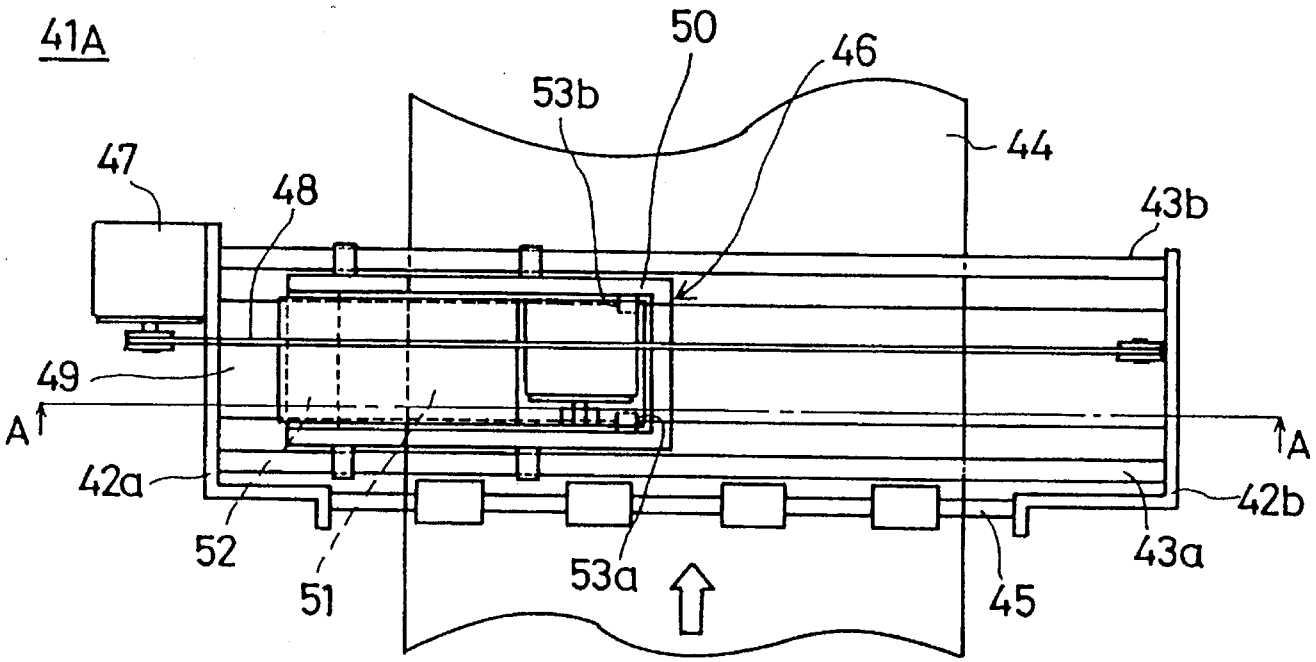
FIGS. 3A and 3B show a structure of a serial-type electrophotographic printer in a first embodiment of the present invention.
Figure 3B:
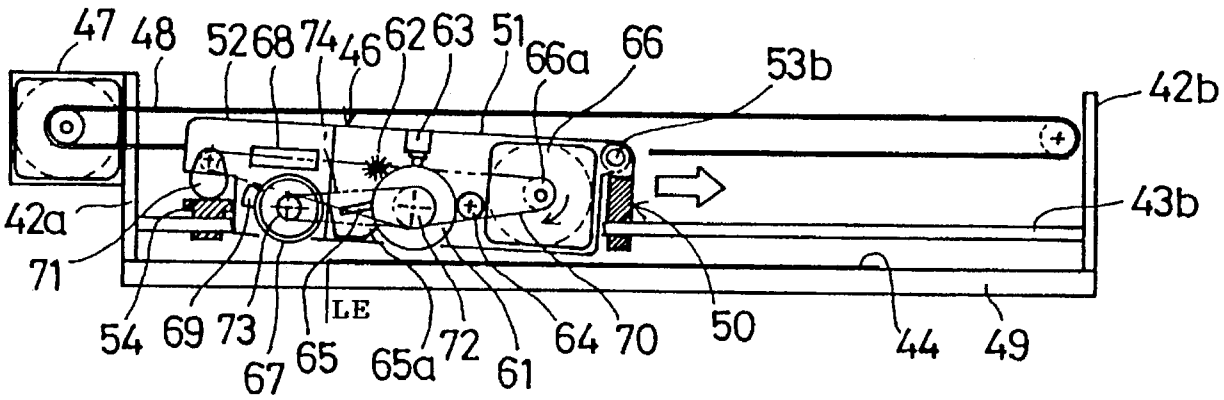

With reference to FIGS. 3A and 3B, a serial-type electrophotographic printer $41_A$ in a first embodiment of the present invention will now be described. FIG. 3A shows a plan view of the printer $41_A$ and FIG. 3B shows a front elevational A—A (in FIG. 3A) sectional view of the printer $41_A$. Guide shafts 43*a* and 43*b* are supported between two frames 42*a* and 42*b*, and also a conveying roller 45 for conveying a recording paper sheet 44 is supported therebetween, as shown in FIG. 3A.

Movement of a carriage 46 is guided by the guide shafts 43*a* and 43*b*, and the carriage 46 is moved in a carriage moving direction which is perpendicular to a recording paper sheet conveying direction by a carrier motor (such as a stepper motor) 47 via a belt 48. Below the carriage 46, as shown in FIG. 3B, a transfer unit 49 is disposed, the unit 49 extending along the carriage moving direction. A predetermined voltage is applied to the transfer unit 49 so as to apply a predetermined electrical potential between the transfer unit 49 and a recording drum 61. The transfer unit 49 is made from, for example, a substrate made from a material such as that of aluminum and an heat-resistant electrically conductive member (for example, a silicon rubber including an electrically conductive material mixed therein) formed on the substrate.

The carriage 46 includes a process unit 51 and fixing unit 52 which are integrated with each other and are linked with a slide member 50 through linking pins 53*a* and 53*b* so that the units 51 and 52 can rotate about the linking pins 53*a* and 53*b*. The units 51 and 52 are linked with a part of the slide member 50, the part being located along a direction reverse to the carriage moving direction. The slide member 50 is slidably supported on the guide shafts 43*a* and 43*b*. A retreating portion 54 is provided in a home position side (printing starting position side) of the slide member 50.

The process unit 51 includes the recording drum (image carrying body) 61, a charger 62, an exposure unit 63, a developing roller 64 (showing of toner in the figures is omitted), and a cleaner 65. The charger 62, exposure unit 63, developing roller 64 and cleaner 65 are disposed around the drum 61. The drum 61 has an amorphous silicon photosensitive layer or an organic photosensitive layer provided thereon.

Figure 4A:
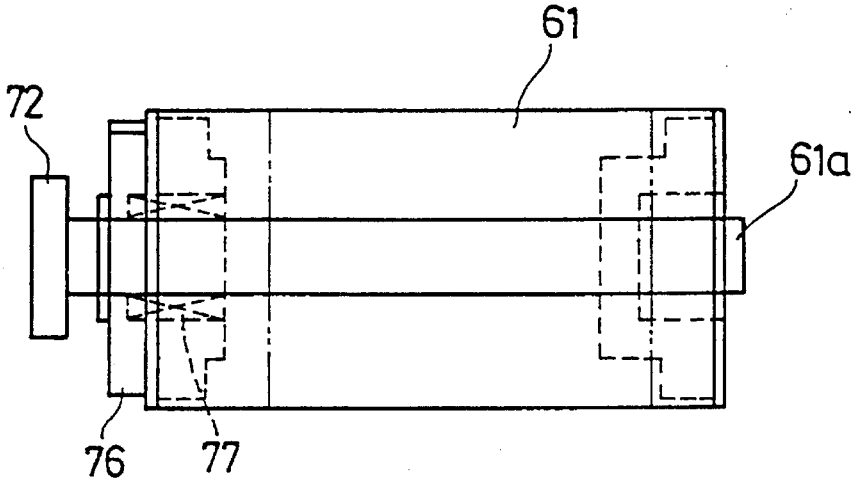
FIGS. 4A and 4B show a structure of a retreating mechanism in the printer shown in FIGS. 3A and 3B.

The drum 61 has a rotation shaft 61*a* shown in FIG. 4A which extends in parallel to the recording paper sheet conveying direction. The drum 61 is rotated at a rotation speed such that a circumferential speed of the drum 61 is the same as a movement speed of the carriage 46. The drum 61 is rotated on the recording paper sheet 44 placed on the transfer unit 49 as shown in FIG. 3A.

The surface of the drum 61 is uniformly charged by the charger 62 and an electrostatic latent image is formed on the surface of the drum 61 by the exposure unit 63. The latent image is changed to a visible toner image as a result of toner appropriately adhering to the drum surface through the developing roller 64. The recording paper sheet 44 is sandwiched between the transfer unit 49 and the drum 61, the transfer unit 49 facing the drum 61. A predetermined electrical potential is applied between the transfer unit 49 and the drum 61 surface. Thus, the toner image which was formed on the drum 61 surface as mentioned above is transferred to the recording paper sheet 44. The developing roller 64 is rotated at a circumferential speed the same as the circumferential speed of the drum 61.

After the image transfer, the charge of the recording drum is removed therefrom and then toner remaining on the drum 61 is removed therefrom by the cleaner 65 down into a tray 65*a*.

Further, a motor 66 is provided within the process unit 51.

The fixing unit 52 includes a fixing roller 67 and a heater (such as a lamp, induction heating coil or the like) 68 provided in proximity to the roller 67. Further, a silicon oil coating unit 69 is provided adjacent to the fixing roller 67 which supplies silicon oil to the fixing roller 28 so that toner is prevented from adhering to the fixing roller 67. Further, a thermistor (not shown in the figures) is provided for detecting a temperature of the fixing roller 67. The temperature of the fixing roller is controlled using the thus-detected temperature.

The fixing unit 52 is provided with an eccentric cam 71 which is rotated via a retreating belt 70 by the motor 66. The motor 66 and eccentric cam 71 constitute a retreating mechanism. The eccentric cam 71 comes into contact with the retreating portion 54 when the cam 71 is rotated a predetermined rotation angle, and thus lifts or rotates upward the carriage 62 clockwise about the linking pins 53*a* and 53*b*. Thus, the carriage enters a retreating state. In proximity to the eccentric cam 71, are provided stoppers 75*a* and 75*b* shown in FIGS. 6A, 6C through 6F, which stoppers control the rotation of the cam 71.

The retreating belt 70 is laid on a pulley 72 mounted on the rotation shaft of the recording drum 61 and a gear mechanism (shown in FIG. 4B) of the eccentric cam 71. A synchronizing belt 74 is laid between the pulley 72 of the recording drum 61 and a pulley 73 of the fixing roller 67. The synchronizing belt 74 is used in synchronizing a rotation speed of the fixing roller 67 with a rotation speed of the recording drum 61. Instead of such a belt system, it is also possible that the fixing roller 67 is coupled with the recording drum 61 using a gear engagement system.

Figure 4B:
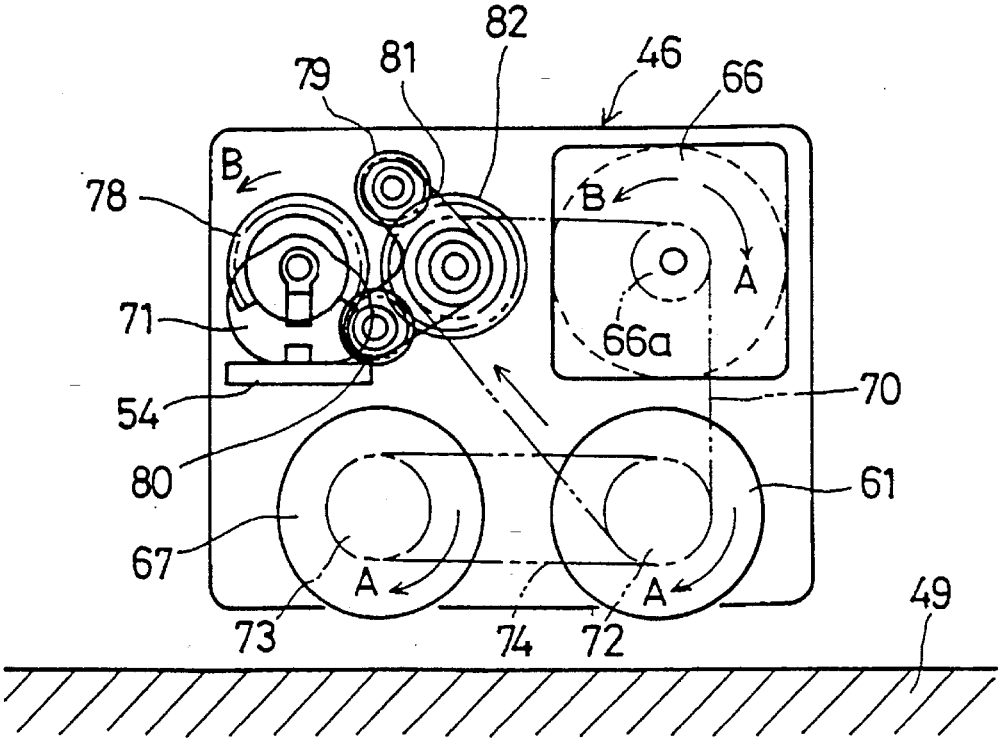

FIGS. 4A and 4B show the structure of the above-mentioned retreating mechanism shown in FIG. 3B. FIG. 4A shows a longitudinal sectional view of the recording drum 61 and FIG. 4B illustrates a concept of the retreating mechanism.

With reference to FIG. 4A, the pulley 72 is mounted on one end of the rotation shaft 61*a* of the drum 61. Further, a unidirectional clutch 77 is provided in the pulley 72 side of the drum 61 via a flange 76 which is pressed into it. The unidirectional clutch 77 transmits only a unidirectional rotational force of the motor 66 to the recording drum 61, while the clutch 77 is connecting the drum 61 and pulley 72. The unidirectional clutch 77 does not transmit a reverse-directional rotational force of the motor 66 to the recording drum 61, even while the clutch 77 is connecting the drum 61 and pulley 72.

With reference to FIG. 4B, a rotation shaft of the eccentric cam 71 has a partial-circle gear 78 mounted thereon. The partial-circle gear 78 has a no teeth part along a part of the circumference of the gear 78, in which part no gear teeth are provided. First and second epicyclic gears 79 and 80 are rotatably mounted on two respective ends of an L-letter-shaped arm 81. The epicyclic gears 79 and 80 can engage with the partial-circle gear 78. The arm 81 is mounted on a rotation shaft of an idler gear 82. The idler gear 82 engages with the epicyclic gears 79 and 80, and the retreating belt 70 is laid on the idler gear 82 via a speed reduction gear (not shown in the figure).

In this retreating mechanism, while the carriage is performing the printing operation, the motor 66 is rotated in a direction A shown in FIG. 4B. As a result, via the retreating belt 70 and synchronizing belt 74, the recording drum 61 and fixing roller 67 are rotated in the direction A. Each of the rotation speeds of the drum 61 and the fixing roller 67 is one such that the circumferential speed thereof is the same as the movement speed of the carriage 46.

At this time, the second epicyclic gear 80 is engaged with the partial-circle gear 78, and thus rotation of the idler gear 82 and second epicyclic gear 80 is transferred to the partial-circle gear 78. However, this rotation transfer cannot be performed in a state in which the epicyclic gear 80 is facing the no-teeth part of the partial circle gear 78. In this state, the eccentric cam is not rotated and the carriage is in a non-retreating state.

While the printing operation is not being performed, that is, after the printing operation has finished and the carriage 46 has returned to the home position, the clutch 77 stops connecting the drum 61 and pulley 72, and thus the pulley 72 is rotated but the recording drum 61 is not rotated. Then, the motor 66 is rotated in a reverse direction (direction B shown in FIG. 4B). As a result, the arm 81 is rotated and thus the first epicyclic gear 79 is engaged with the partial-circle gear 78. Thus, the partial-circle gear 78 is rotated in the direction B through the idler gear 82 and first epicyclic gear 79. As a result, the eccentric cam 71 is rotated and thus, because a longer diameter part of the cam 71 presses the retreating portion 54, the carriage 46 is lifted so as to enter the retreating state.

Figure 5A:
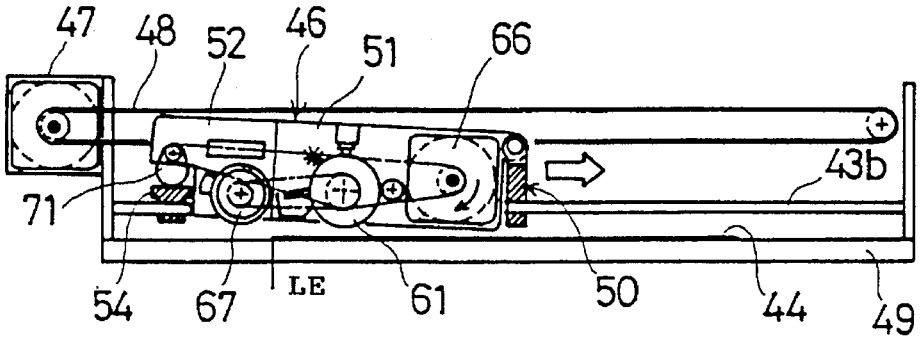
FIGS. 5A, 5B and 5C illustrate an operation of the printer shown in FIGS. 3A and 3B.
Figure 5B:
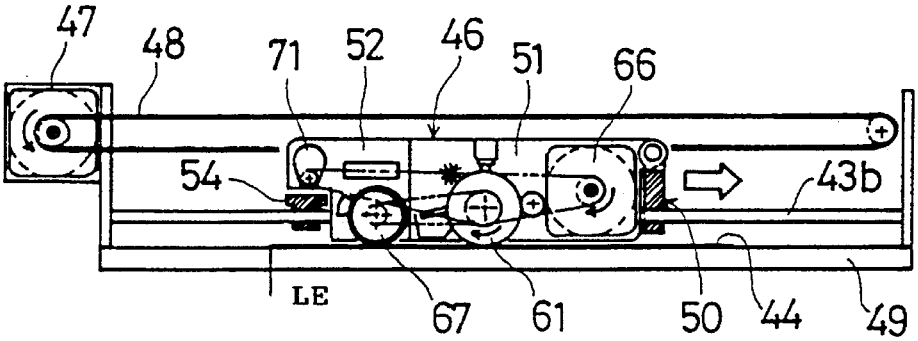
Figure 5C:
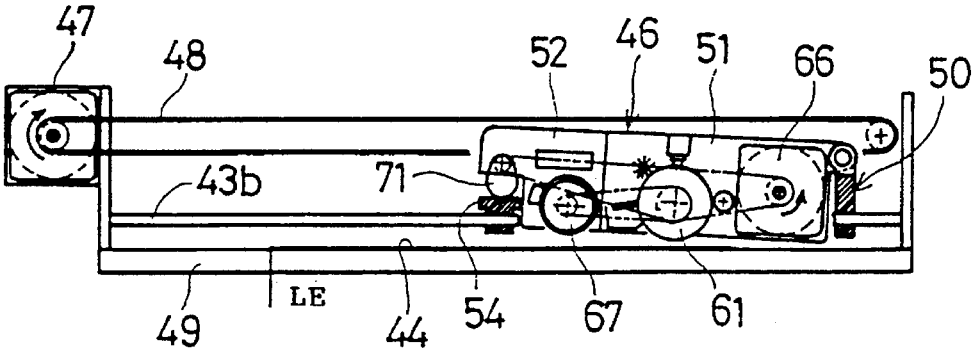

FIGS. 5A, 5B and 5C illustrate an operation of the printer shown in FIGS. 3A and 3B, and FIGS. 6A, 6B, 6C, 6D, 6E and 6F illustrate an approaching operation of the retreating mechanism shown in FIGS. 4A and 4B. FIG. 5A shows a state in which the printing operation is being started. In this state, the carriage 46 is at the home position and also is in the retreating state as a result of the carriage 46 being lifted or rotated upward about the linking pins 53*a* and 53*b* through the eccentric cam 71 and retreating portion 54.

Then, the motor 66 is rotated. Thus, the recording drum 61 is rotated. Simultaneously, the retreating mechanism operates and thus the carriage 46 starts approaching the transfer unit 49, that is, approaching the recording paper 44.

Figure 6A:
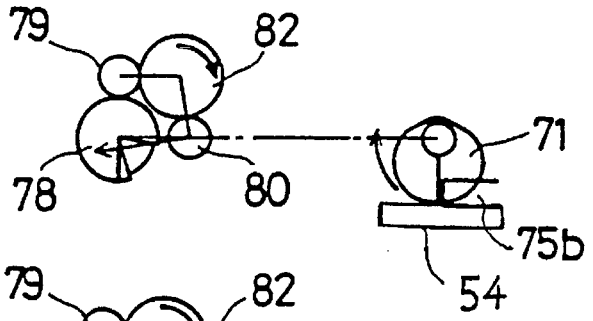
FIGS. 6A, 6B, 6C, 6D, 6E, and 6F illustrate an approaching operation of the retreating mechanism shown in FIGS. 4A and 4B.

That is, with reference to FIG. 6A, when the idler gear 82 is rotated in a direction according to an arrow shown in the figure by the motor 66, the second epicyclic gear 80 coupled to the idler gear 82 is moved as a result of being engaged with the idler gear 82. Thus, the second epicyclic gear 80 is moved in a direction according to an arrow shown in the figure so as to approach the partial-circle gear 78. Simultaneously, the first epicyclic gear 79 is moved so as to move away from the partial-circle gear 78 as the first epicyclic gear 79 is engaged with the idler gear 82.

Figure 6B:
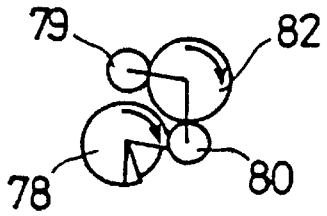

FIG. 6B shows a state in which the eccentric cam 71 is rotated and thus the carriage 46 approaches the transfer unit 49. In this state, as the second epicyclic gear 80 engages with the partial-circle gear 78, the partial-circle gear 78 is rotated in a direction according to an arrow shown in the figure. Thus, the cam 71 is rotated accordingly and thus goes away from the retreating portion 54. As a result, the carriage 46 approaches the transfer unit 49.

Figure 6C:
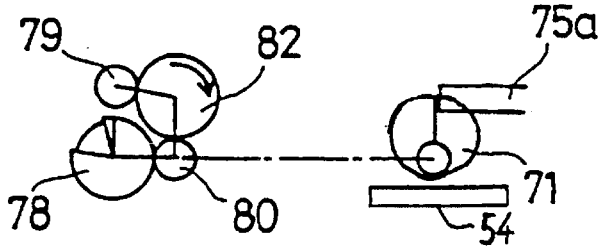

FIG. 6C shows a state in which the carriage 46 has completed the approaching operation, that is, the recording drum 61 and the fixing roller 64 have come into contact with the recording paper sheet 44 placed on the transfer unit 49. Then, when the second epicyclic gear 80 faces the no-teeth part of the partial-circle gear 78 after being rotated as mentioned above, even though the second epicyclic gear 80 is being rotated through the idler gear 82, this rotation of the second epicyclic gear 80 is not transmitted to the partial-circle gear 78. Thus, the eccentric cam 71 is not rotated. Thus, in the state shown in FIG. 6C, the eccentric cam 71 stops its rotation even with the rotation of idler gear 82 after being rotated a predetermined angle. Then, the rotation of the idler gear 82 is continued and thus the rotation of the second epicyclic gear 80 is continued while the eccentric cam 71 is in its rotation stopping state until the motor 66 stops its rotation.

The eccentric cam 71 is rotated 180° between the retreating state of the carriage 46 shown in FIG. 6A and the carriage-approaching-completion state shown in FIG. 6C. However, this rotation angle can be arbitrarily determined as a result of changing the shape of the no-teeth part of the partial-circle gear 78. Further, in the carriage-approaching-completion state shown in FIG. 6C, an air gap is present between the bottom of the eccentric cam 71 and the top of the retreating portion 54. By the provision of this air gap, the eccentric cam 71 is prevented from coming into contact with the retreating portion 54 in the carriage-approaching-completion state even if the position of the carriage in this state is unexpectedly changed. Such an unexpected change of the carriage position may occur because positions of the guide shafts 43*a* and 43*b* are changed due to a mounting position error thereof or because the guide shafts 43*a* and 43*b* are deformed. Such shaft deformations may occur because the slide member 50 bears a pressure occurring due to a reaction force being applied as a result of the fixing roller being pressed against the transfer unit.

With reference to FIG. 5A, the recording drum 61 starts its rotation simultaneously with the starting of the motor 66 rotation. After the rotation speed of the drum 61 has reached a predetermined speed, the charger starts its charging operation. Thus, the surface of the drum 61 is charged uniformly. The retreating mechanism operates so that the approaching operation is completed when the drum 61 has been rotated a predetermined angle.

By the time the drum 61 is rotated the predetermined angle and the approaching operation is completed, the rotation speed of the carrier motor 47 has reached a predetermined speed. Further, by the time the approaching operation is completed, the electrostatic latent image formed on the drum 61 by the exposure unit 63 has been changed to the visible toner image through the developing roller 64 and the drum 61 has reached a printing starting position.

At the time the approaching operation is completed, each of the recording drum 61 and the fixing roller 67 is rotated at a circumferential speed the same as a moving speed of the carriage 46. If the former speed is not the same as the latter speed, the recording paper sheet 44 may be moved in the carriage moving direction due to friction between either one of the drum 61 and fixing roller 67 and the paper sheet 44. If such a phenomenon occurs, a subsequent printing operation may not result in printing in a correct position on the paper sheet 44.

It is possible to perform a certain operation through the drum 61 and fixing roller 67, which operation is similar to the actual printing operation excepting that the certain operation is performed in a position of the carriage 46 below which position no recording paper sheet 44 is placed. That is, the certain operation may be, for example, a warming up operation performed when the carriage 46 is in the home position. In such a case, the carriage 46 is placed on a base (not shown in the figures) and each of the drum 61 and fixing roller 67 may come into contact with the base. If the certain operation is performed, each of the drum and fixing roller is rotated and thus the carriage 46 may unexpectedly be moved on the base and thus may move away from the home position although the carrier motor 47 does not run. In order to prevent such a problematic situation, for example, an extra power transmission mechanism such as a worm gear is inserted between the rotation shaft of the carrier motor 47 and the belt 48. Thus, it is possible to increase a locking force which is applied to the carriage 46 by the carriage 46 driving mechanism including the carrier motor 47 and belt 48. The locking force is applied to the carriage 46 so as to prevent the carriage 46 from being unexpectedly moved when the carrier motor 46 stops its running.

Thus, each of the recording drum 61 and fixing roller 67 starts its rotation while the carriage is approaching the transfer unit 44. Then, the surface of the drum 61 is uniformly charged. Then, a timing at which the exposure unit 73 starts forming the electrostatic latent image on the drum 61 is used as a trigger. By using the trigger, rotation of the carrier motor 47 is started after the recording drum 61 has been rotated a predetermined angle. Thus, it is possible to reduce an extra distance for which the drum 61 is being rotated in order to cause rotation speed of the drum 61 to reach a predetermined speed before the carriage reaches a printing starting position. Further, it is possible that the printing operation can be started at an accurate printing starting position on the recording paper sheet 44.

In FIG. 5B, the approaching operation has been completed. Then, after the toner image formed on the recording drum 61 has reached an image transfer point, an electrical potential reverse to that of the charge of the toner is applied to the transfer unit 49. As a result, the toner on the recording drum 61 is transferred to the recording paper sheet 44. Then, the thus-transferred toner is fixed onto the recording paper sheet 44 by the fixing roller 67 which has been heated to the predetermined temperature. Thus, the toner image on the recording drum 61 is transferred and fixed onto the recording paper sheet 44.

As shown in FIG. 5C, after a line of an image part has been thus printed on the recording paper sheet, the carrier motor 47 stops its rotation and thus the movement of the carriage is stopped after reduction of the movement speed. Simultaneously, the rotation of the motor 66 is stopped after the same reduction of the rotation speed. Then, the motor 66 is rotated in the reverse direction as shown in FIG. 5C. As a result, the carriage enters the retreating state. At this time, due to the function of the unidirectional clutch 77, the rotation force of the motor 66 is prevented from being transmitted to the recording drum 61.

Figure 6D:
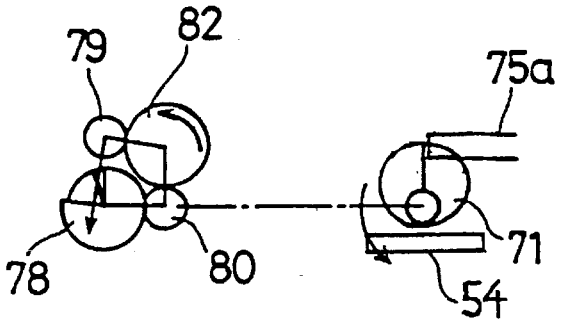
Figure 6E:
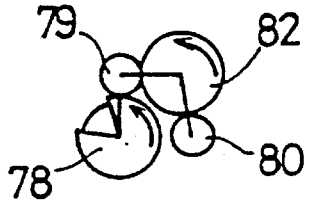

A carriage retreating operation is thus performed as shown in FIGS. 6D and 6E. That is, as shown in FIG. 6D, the motor 66 is rotated in a direction reverse to a direction in which the motor 66 is rotated so that the recording drum 61 is rotated for performing the printing operation. As a result, the idler gear 82 is rotated in a direction according to an arrow shown in FIG. 6D. Thus, the first epicyclic gear 79 approaches the partial-circle gear 78 while the second epicyclic gear 80 moves away from the partial-circle gear 78.

Then, as shown in FIG. 6E, the first epicyclic gear 79 engages with the partial-circle gear 78 which is thus rotated in a direction the same as a direction in which the idler gear 82 is rotated. Thus, the eccentric cam 71 coupled to the partial-circle gear 78 is rotated. As a result, the eccentric cam 71 presses against the retreating portion 54 and thus the carriage 46 is lifted to enter the retreating state.

Figure 6F:
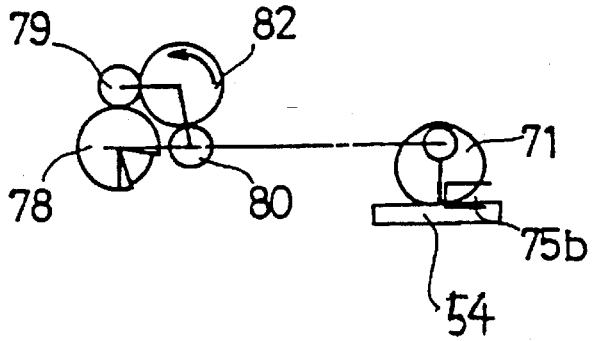

Then, after the partial-circle gear 78 has been rotated as shown in FIG. 6F and thus the first epicyclic gear 79 is facing the no-teeth part, the rotation force of the first epicyclic gear 79 which is being rotated by the idler gear 82 is no longer transmitted to the partial circle gear 78. Thus, a rotation angle of the eccentric cam 71 has been controlled and thus the eccentric cam 71 has stopped its rotation appropriately. Thus, the retreating state of the carriage 46 is maintained even though the motor 66 does not stop its rotation. An approach angle $\Theta 4+\Theta 5$ (which will be described later) is enough as the rotation angle of the above-mentioned reverse rotation of the motor 66.

Thus, the first and second epicyclic gears 79 and 80 are used in the carriage approaching and retreating operations. As a result, approaching timing of the carriage 46 relevant to a rotation angle of the recording drum 61 can be freely determined by changing a reduction ratio in the retreating mechanism. Therefore, it is possible to ensure an accurate retreating timing.

With reference to FIG. 5C, after the printing operation by the carriage 46 has been finished and the carriage 46 has entered the retreating state, the carrier motor 47 is rotated in a direction according to an arrow shown in the figure. Thus, the carriage 46 is returned to the home position.

It is possible to use a stepper motor as the carrier motor 47 as mentioned above. If the stepper motor is used for this purpose, it is effective to switch an excitation method of the stepper motor. That is, a 1–2 phase excitation is used when the carriage 46 is moved in the printing operation, and a 2 phase excitation is used when the carriage 46 is returned to the home position. Thus, it is possible to increase a printing speed.

After the carriage 46 has been returned to the home position, the conveying roller 45 conveys the recording paper sheet 44. Thus, the recording paper sheet 44 is positioned so that the carriage 46 is located above a position of the paper sheet 44, at which position the carriage 46 will print a subsequent line of image part. The above-described series of operations are repeated and thus a page of image is printed.

A driving source of the retreating operation of the carriage 46 is not limited to the use of the motor 66 which is also used in driving the recording drum 61 and fixing roller 67. A driving source, such as a miniature DC motor or a solenoid, in addition to motor 66 may be provided for performing the retreating operation of the carriage 46. If such an additional driving source is provided for the carriage retreating operation, the unidirectional clutch 77 provided in the recording drum 61 is no longer needed to be provided.

Figure 7A:
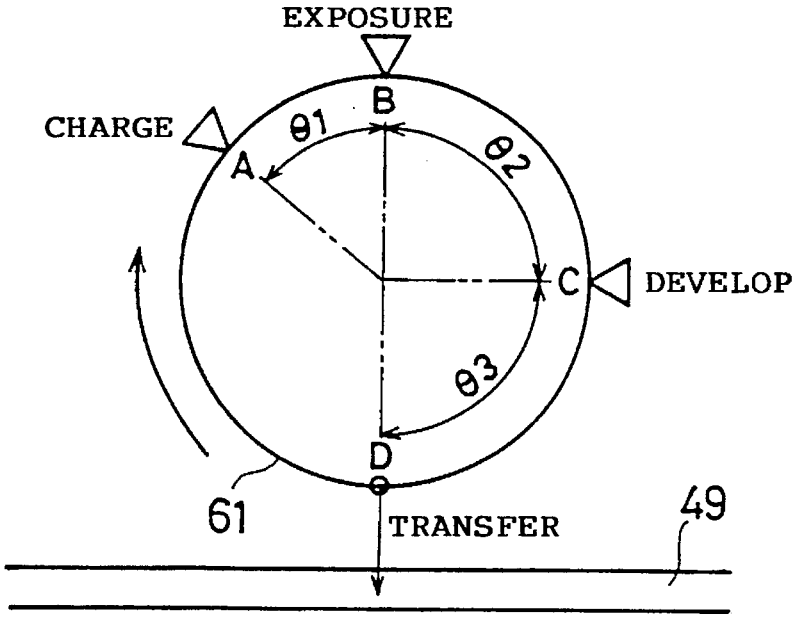
FIGS. 7A, 7B, 8A, 8B and 8C illustrate an approaching operation of a recording drum in the printer shown in FIGS. 3A and 3B.

With reference to FIGS. 7A, 7B, 8A, 8B, 8C, 9A, 9B and 9C, operations of the recording drum in the approaching operation will now be described. As shown in FIG. 7A, an angle between the charger 62 and the exposure unit 63 is Θ1, an angle between the exposure unit 63 and the developing roller 64 is Θ2, an angle between the developing roller 64 and the transfer unit 49 is Θ3.

In a state I shown in FIG. 7A, the carriage is stopped in the retreating state. This state is either a state in which the carriage 46 is in the home position or in a state in which the carriage 46 is above the recording paper sheet 44. FIGS. 9A, 9B and 9C show a timing chart in the state in which the carriage 46 is above the recording paper sheet 44. (However, in the timing chart, distances are shown, which distances the carriage 46 moves horizontally in FIGS. 7A, 7B, 8A, 8B and 8C for relevant times.) From this state, in order to start the approaching operation by the carriage 46, the motor 66 starts its rotation and thus the recording drum 61 starts its rotation. Thus, the above-described retreating mechanism causes the carriage 46 to start the approaching operation. Thus, the carriage 46 starts approaching the transfer unit 49. At this time, the carrier motor 47 is not being rotated and thus the carriage 46 is not being moved as shown in FIG. 9C.

Figure 7B:
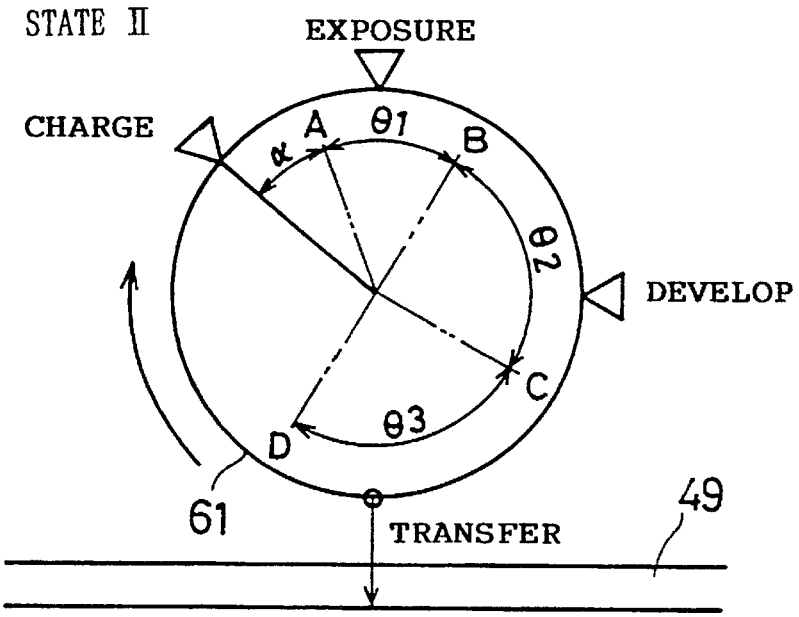

Then, the recording drum 61 enters a state II shown in FIG. 7B after being rotated an angle α. Then, a bias electric potential is applied to the charger 62 mounted in the carriage 46. As a result, the surface of the recording drum 61 is uniformly charged as shown in FIG. 9A. In order ensure the uniform charging, the charging should be started after the rotation speed of drum 61 has reached a predetermined speed after increasing from its static state. This predetermined speed, which is a speed obtained as a result of being driven by the motor 66, is one such that a circumferential speed of the drum 61 is the same as a carriage moving speed in the printing operation.

Figure 8A:
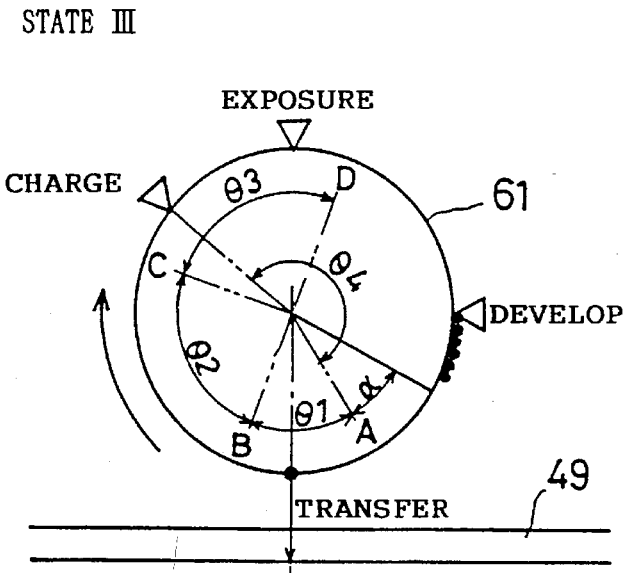

Then, in a state III shown in FIG. 8A, the recording drum 61 has been rotated the angle Θ4. In this state, the carriage 46 is undergoing the approaching operation and therefore neither the recording drum 61 nor the fixing roller 49 has come into contact with the recording paper sheet 44. While the recording drum 61 is being rotated until the rotation angle reaches the angle Θ4, the exposure unit 63 forms an electrostatic latent image on the recording drum 61 and then the developing roller 64 forms a relevant toner image. By causing an exposure starting timing to be coincident with a timing when the carrier motor 47 starts its rotation, it is possible to cause a position of the recording paper sheet at which the printing is started to be an appropriate position.

Thus, while the recording drum 61 is being rotated until the rotation angle reaches the angle Θ4, the carriage 46 is undergoing the approaching operation, the developing roller 64 supplies toner to the latent image formed on the drum 61, the carrier motor 47 starts its rotation, and thus the carriage 46 starts its movement as shown in FIG. 9B.

Figure 8B:
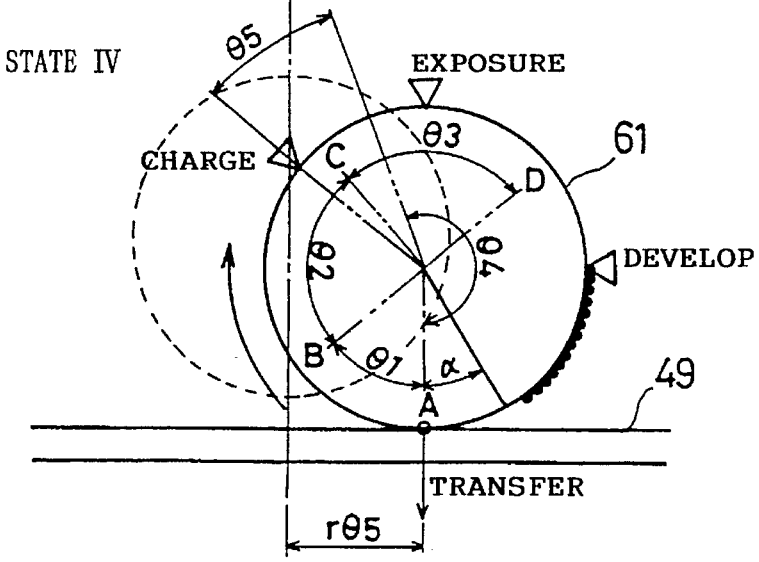

Further, as shown in FIGS. 8B and 9C, the recording drum 61 is rotated Θ5, that is, is rotated Θ4+Θ5 from the state I shown in FIG. 8A in which the drum 61 started its rotation. Then, the approaching operation of the recording drum 61 and fixing roller 67 is completed due to the function of the retreating mechanism as shown in FIG. 9C. While the drum 61 is being rotated until the rotation angle reaches Θ4+Θ5, the carrier motor 47 is increasing its rotation speed and then moving speed of the carrier 46 reaches a predetermined speed. The angle Θ5 is determined from a speed reduction ratio of the speed reduction gear provided on the idler gear 82.

Thus, the recording drum 61 moves rightward in FIG. 8B as it performs the approaching operation. While the drum 61 is being rotated until the rotation angle reaches Θ5, the drum 61 moves from a position shown by a broken-line circle to a position shown by a solid-line circle of the drum 61. Thus, the approaching operation is completed.

Thus, at a moment at which the approaching operation is completed, a circumferential speed of each of the drum 61 and fixing roller 67 is the same as a movement speed of the carriage 46. Therefore, no unwanted friction is applied to the recording paper sheet 44 on the transfer unit 49.

Figure 8C:
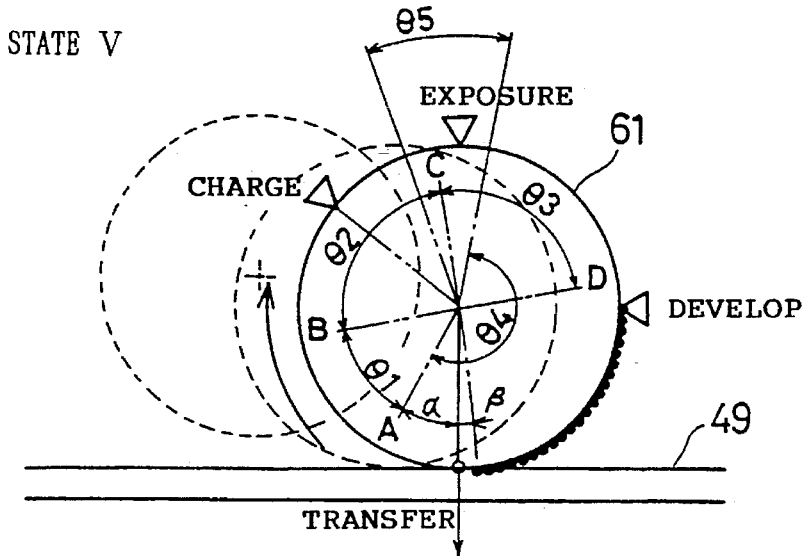

The carriage 46 thus completes the approaching operation and then the carriage 46 further moves rightward. As shown in FIG. 8C and 9A, the drum 61 is rotated an angle α+Θ1+Θ2+Θ3 from the state I shown in FIG. 8A. Thus, the drum 61 enters a state V shown in FIG. 8C. Then, an electrical potential reverse to that of the charged toner on the drum 61 is applied to the transfer unit 49. As a result the toner image on the drum 61 is transferred to the recording paper sheet 44.

Then, the fixing roller 67 in the carriage 46 fixes the thus-transferred toner image onto the paper sheet 44 using pressure and heat of the roller 67. In a time for which the carriage 46 moves a distance X shown in FIG. 9B, the rotation speed of the carrier motor 47 reaches the predetermined speed from the static state. In order to minimize the distance X (which will be referred to as a 'starting up distance' hereinafter) which the carrier 46 moves rightward in the time X, each dimension may be determined according to equations described below.

If it is assumed that a radius of the drum 61 is 'r', rΘ4+rΘ5 is constant The above-mentioned starting up distance X is obtained from the above-mentioned speed reduction ratio of the speed reduction gear. That is, $$r\Theta 4+X=r(\alpha+\beta)+r(\Theta 1+\Theta 2+\Theta 3) \quad (1).$$

Therefore, the starting up distance X is obtained as a result of:

$$X=r(\Theta 1+\Theta 2+\Theta 3-\Theta 4)+r(\alpha+\beta) \quad (2).$$

In this case, $X>r\Theta 5$.

FIGS. 10A, 10B and 10C show a timing chart in a state in which the carriage 46 is in the home position. (However, in the timing chart, distances are shown, which distances the carriage 46 moves horizontally in FIGS. 7A, 7B, 8A, 8B and 8C for relevant times.) The approaching operation in this state is not one for actual printing but for, for example, warming up the carriage 46. In the warming up, the recording drum 61 and the fixing roller 67 are rotated respectively. For the purpose of warming up, each of the angles $\Theta 4$ and $\alpha$ is larger than that in the case of FIGS. 9A, 9B and 9C. As the drum 61 is rotated a predetermined angle, the approaching operation is performed.

As shown in FIG. 10C, when the drum 61 is rotated 86, the approaching operation is completed. In this case, neither the drum 61 nor the fixing roller 67 is positioned above the recording paper sheet 44 on the approaching operation. The recording drum 61 and fixing roller 67 may run idle even when the carriage 46 does not move horizontally.

The starting up distance X in this case is obtained similarly to the method in the case where the carriage 46 is above the recording paper sheet 44, if rotation of the carrier motor 47 is started when the exposure is started. The starting up distance X is obtained as a result of:

$$X=r(\Theta 1+\Theta 2+\Theta 3-\Theta 4)+r(\alpha+\beta(r\Theta 6 \text{ is constant}) \quad (2).$$

Thus, the retreating mechanism can be easily realized as a result of using the eccentric cam 71 provided in the carriage 46. Further, it is also possible to reduce the starting up distance of the carriage 46 required before the printing starting. Thus, the printer can be miniaturized. Further, the motor 66 is commonly used for driving the recording drum 61 and also for driving the eccentric cam 71. Thus, the costs can be reduced. Further, completion of the approaching operation of the carriage 46 can be performed without applying unwanted friction to the recording paper sheet 44. Therefore, it is possible to start printing from a middle position in the recording paper sheet. Thus, high-speed printing can be realized.

Figure 11A:
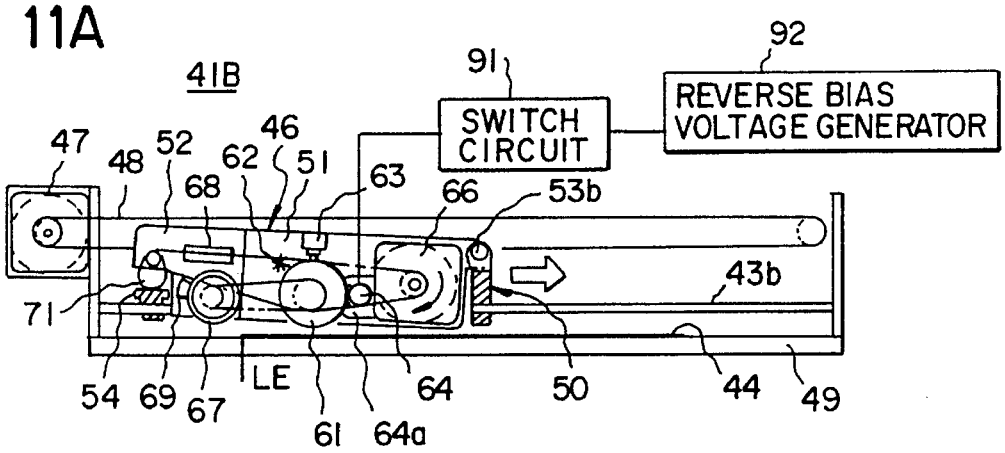
FIGS. 11A, 11B and 11C show a structure and an operation of a serial-type electrophotographic printer in a second embodiment of the present invention.
Figure 11B:
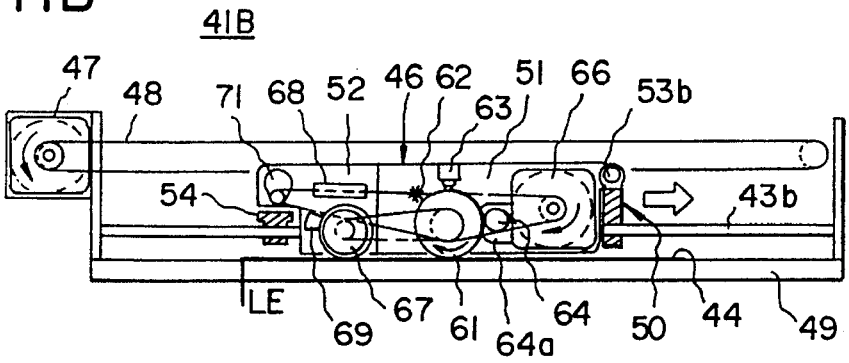
Figure 11C:
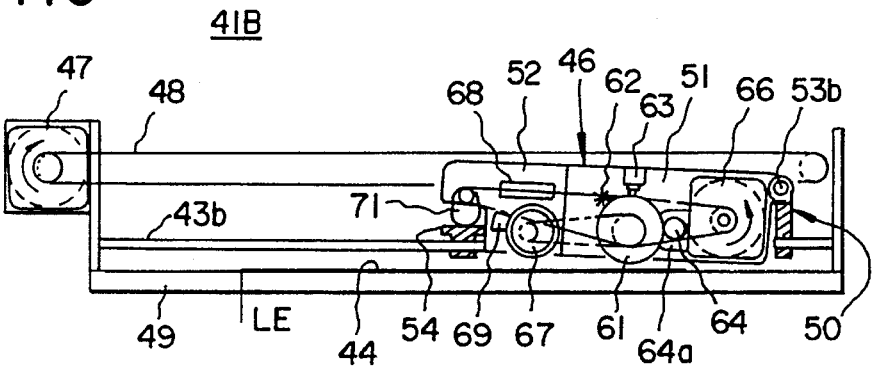

With reference to FIGS. 11A, 11B and 11C, a serial type electrophotographic printer $\mathbf{41}_B$ in a second embodiment of the present invention will now be described. The printer $\mathbf{41}_B$ in the second embodiment is obtained as a result of eliminating the cleaner 65 and the tray 65*a* from the process unit 51 of the above-described printer $\mathbf{41}_A$ in the first embodiment and also connecting a reverse-bias voltage generator 92 to the developing roller 64 of the of the above-described printer $\mathbf{41}_A$ in the first embodiment via a switch circuit 91. Except for these modifications, the printer in the second embodiment is similar to the printer in the first embodiment. The switch circuit 91 includes a high-voltage-proof relay. Showing of the switch circuit 91 and reverse-bias voltage generator 92 is omitted in FIGS. 11B and 11C.

FIG. 11A shows a state in which the carriage 46 is in the home position.

In the retreating state before the printing operation is performed, charging has not been performed for a part of the recording drum 61 between a position which the charger 62 is facing and a position which the developing roller 64 is coming into contact with. Otherwise, even if the above-mentioned part of the drum 61 was previously charged, a sufficient time has elapsed. Therefore, an electrical potential of the part of the drum 61 is 0 volts. If the drum 61 is rotated, toner 64*a* is supplied by the developing roller 64 and thus a solid-black toner image is formed on the part of the drum 61.

If the recording drum 61 having the solid-black toner image formed thereon approaches the recording paper sheet 44 in the approaching operation and then the printing operation is performed, the solid-black toner image is transferred to the paper sheet 44. In order to prevent such a problematic situation from occurring, before the performing of the printing operation in the retreating state, charging of the drum 61 is started and the drum 61 is rotated by the motor 66. The black toner image formed on the drum 61 passes by the charger 62 and the exposure unit 63. Then, the developing roller 64 collects the toner of the solid-black toner image, as the developing roller 64 is being rotated at a speed such that a circumferential speed of the developing roller 64 is higher than a circumferential speed of the drum 61.

In order to improve a rate of collecting the toner on the drum 61 by the developing roller 64, a bias electrical potential of a polarity reverse to a polarity of charge of the charged toner 64*a* is applied to the developing roller 64 by the reverse-bias voltage generator 92 via the switch circuit 91.

Thus, the toner 64*a* on the recording drum 61 is attracted by and thus adheres to the thus-biased developing roller 64. The thus-adhering toner is then removed from the developing roller 64 as a result of the application of the electrical potential to the developing roller 64 being broken by switching of the switch circuit 91. The thus-removed toner is then collected in a certain position. Thus, the recording drum 61 is cleaned. Then, the drum 61 is uniformly charged by the charger 62, an electrostatic latent image is formed thereon by the exposure unit 63, and then a relevant toner image is formed by the developing roller 64.

Then, as shown in FIG. 11B, movement of the carriage is started and simultaneously the above-described retreating mechanism in the carriage 64 operates. Thus, the drum 61 comes into contact with the recording paper sheet 44 and the toner image formed on the drum 61 is transferred to the paper sheet 44 by the transfer unit 49.

A diameter of the recording drum 61 is previously determined such that the drum 61 is rotated twice when the carriage 46 moves in the main scan direction from the left end to the right end of a printable carriage moving extent in FIGS. 11A, 11B and 11C, that is, when the carriage completes a forward main-scan-line movement. The printable carriage moving extent corresponds to a maximum printable extent along the main-scan-line direction of the recording paper sheet 44. The thus-predetermined diameter of the drum 61 is 33 millimeters. Remaining toner on the drum 61 is removed when the carriage is in the home position as described above. Thus, the drum 61 is rotated for the first time after the drum 61 is completely cleaned. However, theoretically speaking, remaining toner on the drum 61 present after the first-time rotation of the drum 61 has been finished may not be completely cleaned before the second time rotation of the drum 61 is started only as a result of the developing roller 64 collecting the toner by coming into contact with the drum 61. However, even if an amount of toner which could not be collected by the developing roller 64 before a subsequent rotation of the drum after the first rotation is transferred to the paper sheet 44, because this amount of toner is little enough, unless such transfer is repeated and thus the toner is overlaid, actual printing can be performed without causing substantial printed image degradation.

Then, as shown in FIG. 11C, after the carriage has completed the forward main-scan-line movement and thus printing of one line of image part has been finished, the retreating operation is performed. Then, as the retreating state of the carriage 46 is being kept, the carriage 46 performs a backward main-scan-line movement.

Then, before a subsequent forward main-scan-line movement is performed by the carriage 46, toner 64*a* which could not be collected by the developing roller 64 in the second-time rotation of the drum 64 is collected. By this toner collection, remaining toner on the drum 64 can be completely removed before a start of an operation for printing a subsequent line of image part. This toner collection is performed by applying the reverse-bias electrical potential to the developing roller 64 as switching of the switch circuit 91 is performed. In the toner collection, the recording drum 61 is rotated several times. Thus, the developing roller 64 completely collects the remaining toner on the drum 61.

Thus, a printing quality can be improved and a provision of the cleaner can be omitted. As a result, the printer can be miniaturized and the costs can be reduced.

This toner collection operation can be performed when the carriage 46 is being returned to the home position, that is, when the carriage is performing the backward main-scan-line movement. Thereby, a number of rotations of the drum 61 when the carriage 46 is in the home position can be reduced. Thus, high-speed printing can be achieved. Further, it is possible that the diameter of the drum 61 is enlarged so that only one rotation of the drum 61 can result in printing of an entire one line of image part, that is, so that the circumference of the drum 61 is equal to the maximum printable extent along the main-scan-line direction of the recording paper sheet 44. By this diameter enlargement, the printing quality can be further improved because the above-mentioned toner collection operation is performed every rotation of the drum 61.

Further, the concept of the above-described printer in the second embodiment of the present invention in which the remaining toner is effectively collected can also be applied to any printers having structures different from the structure of the printer shown in FIGS. 11A, 11B and 11C but having carriage retreating mechanisms.

Figure 12A:
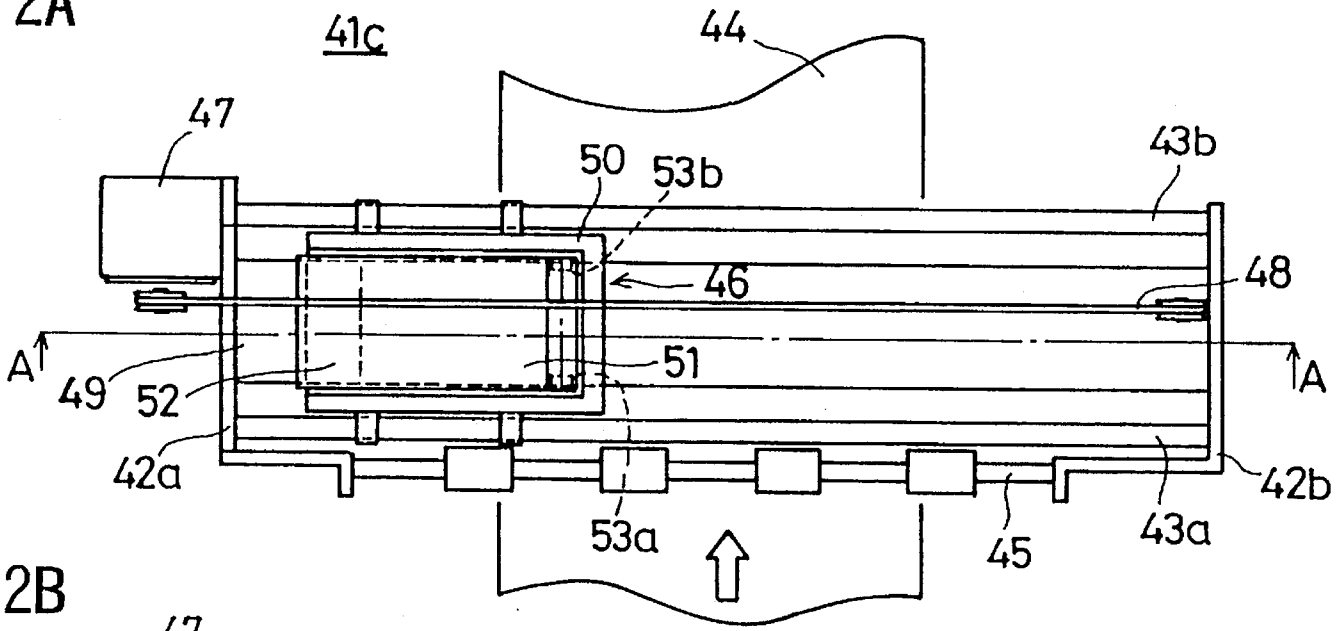
FIGS. 12A and 12B show a structure of a serial-type electrophotographic printer in a third embodiment of the present invention.
Figure 12B:
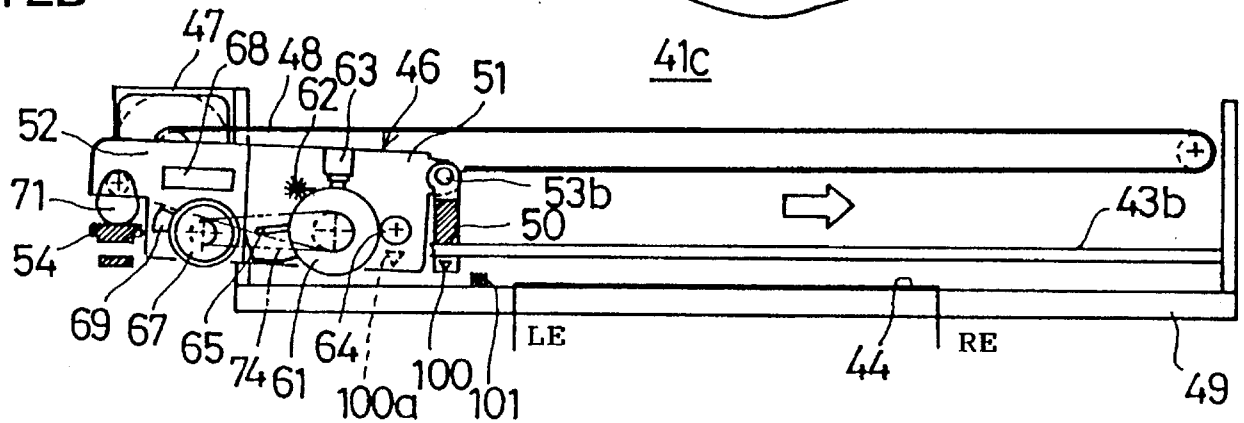

With reference to FIGS. 12A and 12B, a serial-type electrophotographic printer $41_C$ in a third embodiment of the present invention will now be described. FIG. 12A shows a plan view of the printer and FIG. 12B shows a front elevational A—A (in FIG. 12A) sectional view of the printer.

The printer in the third embodiment is obtained as a result of modifying the above-described printer $41_A$ in the first embodiment as follows: The motor 66 of the printer $41_A$ is eliminated; a sensor (reflection type sensor) 100 for detecting an edge of the recording paper sheet 44 is additionally provided in the slide member 50; and further a cleaning member 101 such as a brush, felt or the like is additionally provided at the home-position side of the transfer unit 49. (The reflection-type sensor emits light to a subject and then receives the light reflected from the subject. Thus, how white the substance can be measured.) The cleaning member 101 is used such that the sensor 100 slides on the cleaning member 101 every time the carriage 46 passes above the transfer unit 49. Thus, the sensor 100 is cleaned. Further, the eccentric cam 71 is rotated by a special driving unit (not shown in the figures). Except for these modifications, the structure of the printer in the third embodiment is similar to that of the printer in the first embodiment.

In FIGS. 12B, 13A, 13B, 13C, 14A, 14B and 14C, a reference numeral RE shows the right edge of the recording paper sheet 44, while the reference numeral LE shows the left edge of the recording paper sheet 44 as mentioned above.

Figures 13A, 13B, 13C:
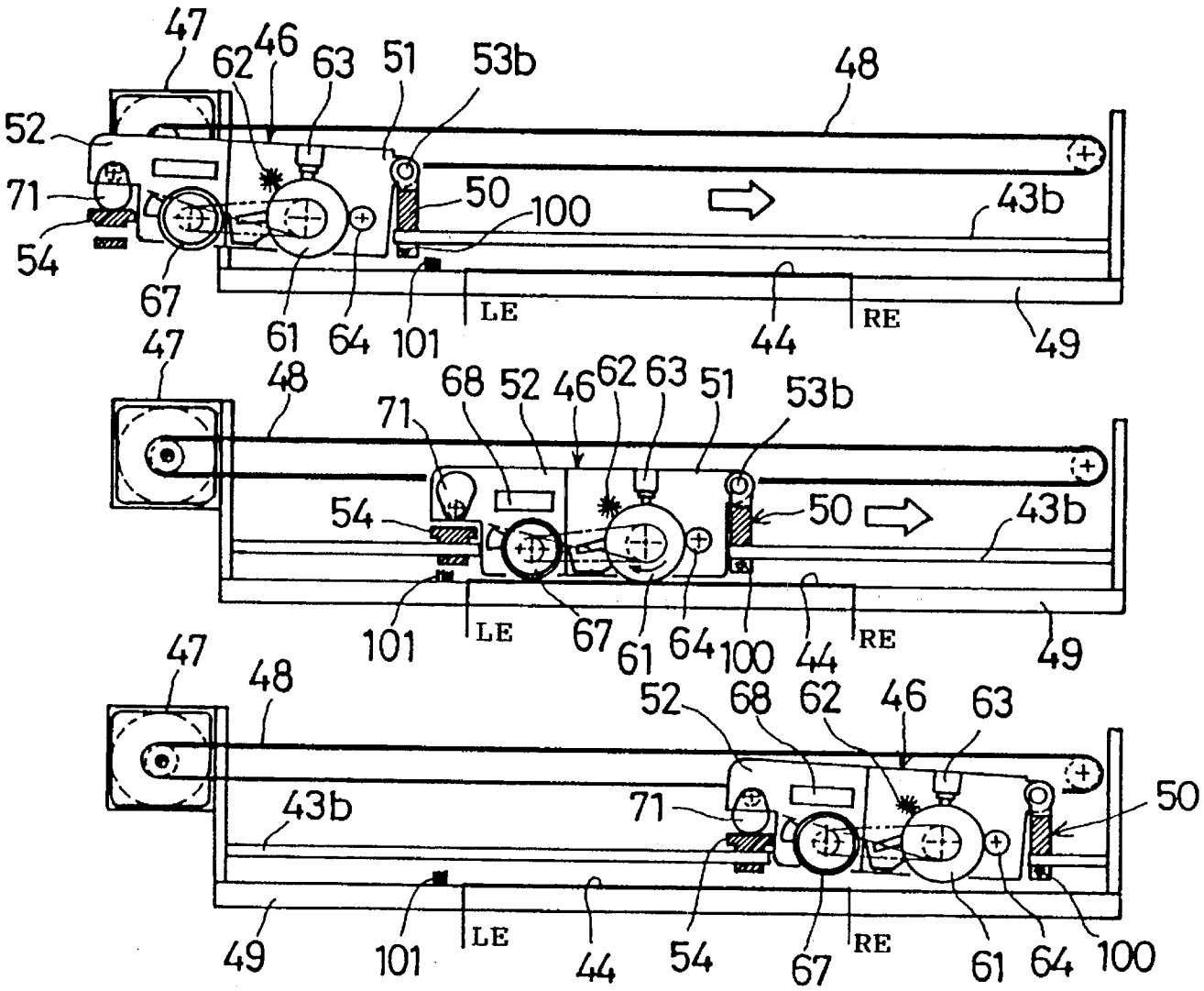
FIGS. 13A, 13B and 13C illustrate an operation of the printer shown in FIGS. 12A and 12B.

With reference to FIGS. 13A, 13B and 13C, an operation of the printer in the third embodiment will now be described. FIG. 13A shows a state in which the carriage 46 has retreated due to the function of the eccentric cam 71 and the retreating portion 54. The transfer unit 49 is made of a black heat-resistant electrically-conductive rubber. In the state shown in FIG. 13A, the sensor 100 is facing this black rubber of the transfer unit 49, and thus is detecting the black of the black rubber. Thus, the sensor 100 is not detecting the recording paper sheet 44.

Then, the carriage 49 moves rightward as it performs the approaching operation to the paper sheet 44. Thus, a state shown FIG. 13B is entered. Between the state shown in FIG. 13A and that of FIG. 13B, a distance between the sensor 100 and the transfer unit 49 is fixed because the distance between the slide member 50 on which the sensor 100 is mounted and the transfer unit 49 is fixed. Therefore, a detecting work can be reliably performed by the sensor 100.

As the sensor 100 passes on the cleaning member 101 when the carriage 46 moves rightward, a detection surface of the sensor 100 is cleaned. Immediately after the sensor 100 has passed a position above the left edge LE of the paper sheet 44 in a state between the state shown in FIG. 13A and that shown in FIG. 13B, the sensor 100 detects white of the paper sheet 44. Then, the exposure unit 63 starts its exposure operation. A rotation speed of the drum 61 has already reached a constant speed and the charging operation has been performed in the state shown in FIG. 13A. The exposure timing will be detailed later.

After the carriage 46 has further moved rightward, the sensor 100 passes a position above the right edge RE of the paper sheet 44. Then, the sensor detects the black of the rubber of the transfer unit 49. Thus, the printer determines that the forward main-scan-line movement has been completed, and thus the exposure of the exposure unit is stopped. Thus, toner on the recording drum 61 is prevented from being directly transferred to the transfer unit 49. Then, after the carriage has further moved, a state shown in FIG. 13C is entered. In this black detection through the sensor 100, the printer determines that the right edge RE of the paper sheet 44 has been detected after the sensor 100 detects a continuous length of black.

This is because there may be a case where a blank form is used as the recording paper sheet 44 in which some figures such as frame lines were previously printed. If printing is performed on such a blank form, the sensor may detect black of such figures as frame lines printed on the blank form. In order to prevent the sensor's detection of black of such a previously printed figure from being erroneously treated as the right edge RE of the paper sheet 44, the printer determines that the right edge RE of the paper sheet 44 has been detected after the sensor 100 has detected a continuous length of black. This continuous length of black may be determined to be approximately 2 millimeters for example. Then, after the right edge RE has been detected, the carriage 46 performs the retreating operation. Then, the carriage 46 is returned to the home position shown in FIG. 13A. In the returning, the sensor 100 surface is also cleaned by the cleaning member 101.

Figure 14A:
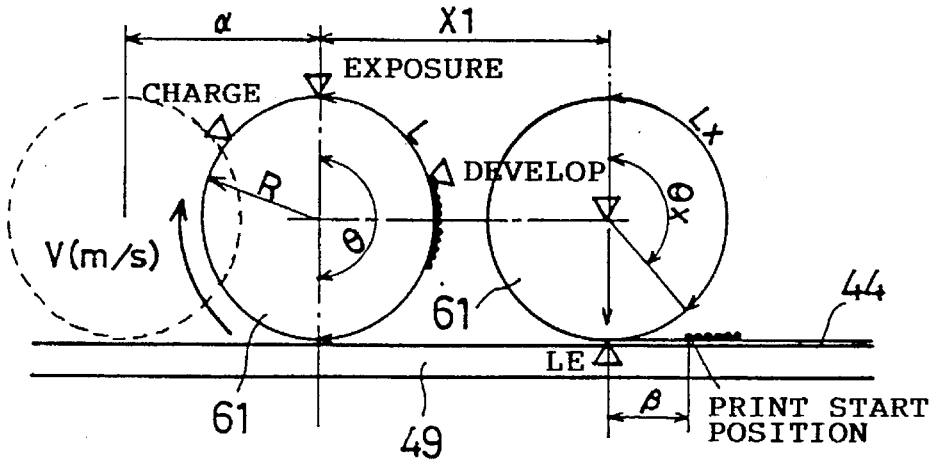
FIGS. 14A and 14B illustrate a printing operation of a recording drum in the printer shown in FIGS. 12A and 12B.
Figure 14B:
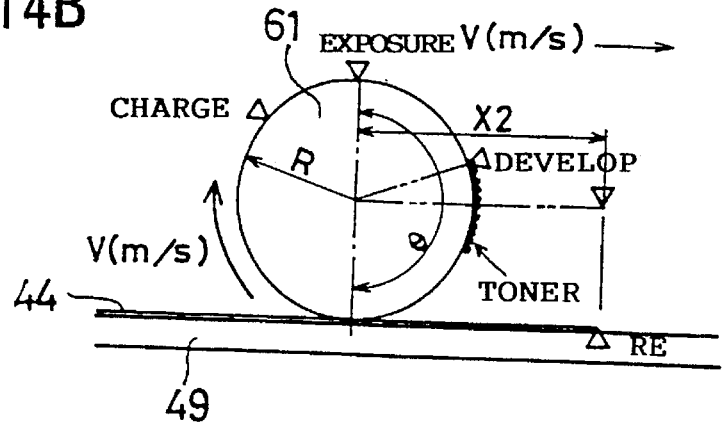
Figure 14C:
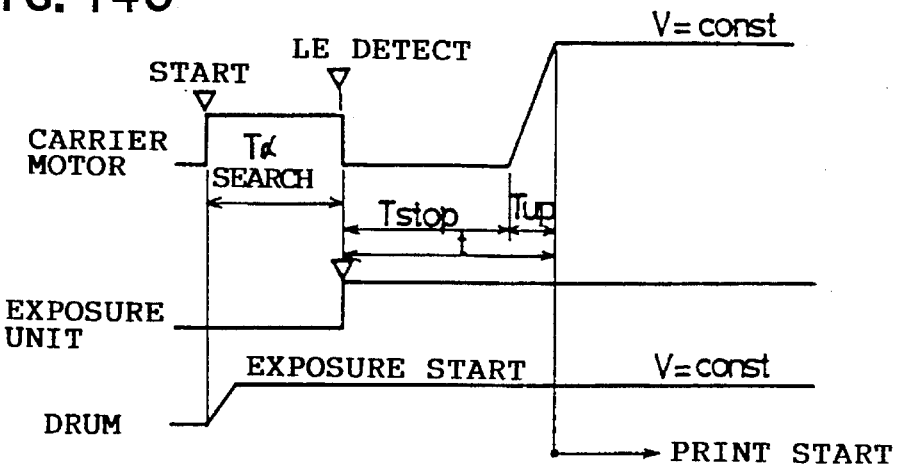
FIG. 14C shows a timing chart of a printing operation of the recording drum in the printer shown in FIGS. 12A and 12B.

With reference to FIGS. 14A, 14B and 14C, the printing operation performed in the printer in the third embodiment will now be described. FIG. 14A illustrates an operation when the left edge LE of the paper sheet 44 is being detected. FIG. 14B illustrates an operation when the right edge RE of the paper sheet 44 is being detected. FIG. 14C shows a timing chart of an exposure operation.

Hereinafter and in FIGS. 14A and 14B a reference letter 'V' indicates a circumferential speed (millimeters/second) of the recording drum 61, that is, a horizontal movement speed of the carriage 46. 'R' indicates a radius of the drum 61. A letter 'L' indicates a circumferential length (RΘ) of the drum 61 between an exposure position and a transfer position 'X1' indicates a distance between a position of the center axis of the drum 61 when the left edge LE of the paper sheet 44 is being detected and the position of the left edge LE of the paper sheet 44. 'X2' indicates a distance between a position of the center axis of the drum 61 when the right edge RE of the paper sheet 44 is being detected and the position of the right edge RE of the paper sheet 44. (In a case where a single sensor 100 is used for detecting the left edge LE and right edge RE of the paper sheet 44 commonly, the distance X2 is the same as the distance X1.) '$t_x$' indicates a time required for the carriage 46 to move the distance X1. 't' indicates a time required for the drum 61 to rotate the circumferential distance L (=RΘ). 'Lx' indicates a circumferential distance ($=Vt_x=R\Theta x$) of the drum 61, which distance the drum 61 rotates while the carriage 46 is moving the distance X1. 'Θx' indicates a rotation angle which the drum 61 rotates while the carriage 46 is moving the distance X1. 'σ' indicates a time elapsing between a time the sensor 100 has detected the left edge LE of the paper sheet 44 and a time the exposure is started. 'β' indicates a left-end margin, and 'τ' indicates a right-end margin.

FIG. 14A illustrates an operation that: the carrier motor (stepper motor) 47 drives the carriage 46 so that the carriage 46 starts the forward main-scan-line movement and thus the carriage 46 moves a distance α (millimeter) at a certain speed; then the sensor 100 detects the left edge LE of the paper sheet 44; and then the carriage 46 further moves rightward the distance X1 (millimeter) and thus the carriage 46 is on the left edge LE.

In this case, because no printing operation is being performed, it is not necessary that the moving speed of the carriage 46 is the same as the circumferential speed of the recording drum 61. However, it is assumed that the recording drum 61 rotates at a constant rotation speed V.

If Lx<L (that is, $t_x<R\Theta/V$, because $Lx=Vt_x$ and $L=R\Theta$), it is not necessary to provide a delay time before starting the exposure. Therefore, if σ=0, a left end margin $\beta=L-Lx=R\Theta-R\Theta x$ is surely obtained in an area adjacent to the left edge LE in the paper sheet 44.

If, however, Lx>L, (that is, $t_x>R\Theta/V$, because $Lx=Vt_x$ and $L=R\Theta$), it is necessary to provide a delay time before starting the exposure. Otherwise, the printing may be started before the drum 61 reaches the left edge LE of the paper sheet 44 or may be started immediately after the drum 61 has reached the left edge LE. If so, no effective left-end margin can be obtained. A delay time required before the start of the printing if the printing is started at the left edge LE is (Lx−L)/V. Therefore, a delay time σ required before the start of the printing if a margin β is to be obtained between the left edge LE and the printing starting position of the paper sheet 44 is obtained by the following equation:

$$\sigma=(Lx-L+\beta)/V.$$

As mentioned above, it is not necessary, before the actual printing is started, that a circumferential speed of the drum 61 is the same as a moving speed of the carriage 46. Therefore, the printing starting position on the recording paper sheet does not depend on the distance X1 determined from the position at which the sensor 100 is mounted. However, the printing starting position does depend on the above-mentioned time t. This time t is a time required for the drum 61 to rotate L which is a circumferential distance between the exposure position (the top of the drum 61 as shown in FIG. 14A) and the transfer position (the bottom of the drum 61 as shown in the figure). Therefore, the time t is a time between a time the exposure operation has been started at a certain position on the drum 61 and a time the above-mentioned certain position on the drum 61 reaches the transfer position (the bottom of the drum 61). The exposure operation is started when the sensor 100 detects the left edge LE of the paper sheet 44. Therefore, the time t is a time between the time the exposure operation has been started and the time the first exposed position on the drum faces the recording paper sheet. The printing starting position on the recording paper sheet is a position which the drum 61 reaches when the time t has elapsed from the time the sensor 100 has detected the left edge LE of the paper sheet 44. Thus, the printing starting position depends on the above-mentioned time t.

Ordinarily, it can be said that, elongating the distance X1 results in enlarging outward dimensions of the printer. Therefore, in order to shorten the distance X1, a structure in which Lx<L as described above is used. This is because, with reference to FIG. 12B, elongating the distance X1 results in the drum mounting position in the carriage 46 should be moved leftward. Accordingly, the other components in the carriage 46 being moved leftward correspondingly. As a result, the left end of the carriage 46 should be moved leftward and thus the printer should be enlarged.

Actually, as shown in FIG. 14C, a relationship between the above-mentioned time t and a starting up time Tup is t>>Tup (actually, for example, t≈10·Tup). The starting up time Tup is a time between a time the carriage 46 has started its movement by the carrier motor 47 and a time a movement speed of the carriage 46 reaches a speed the same as a circumferential speed V (millimeters/second) of the recording drum 61. The exposure operation by the exposure unit 63 is started immediately after the left edge LE of the paper sheet has been detected. Simultaneously, the rotation of the carrier motor is stopped. Then, after a certain time (Tstop) has elapsed, rotation of the carrier motor 47 is started and thus the movement speed of the carriage 46 reaches the speed V. Then, when the time t has elapsed, the above-mentioned first exposed position faces the paper sheet 44 and then the printing is started.

Therefore, by changing the above-mentioned certain time Tstop, it is possible to control a distance which the carriage 46 moves for the time t. Thus, it is possible to control the left-end margin β. Further, the time Tstop may be determined, as shown in FIG. 14C, such that a time the time t has elapsed since the sensor 100 detected the left edge LE of the paper sheet is coincident with a time the starting-up time Tup has elapsed since the carrier motor 47 started its rotation. If the time Tstop is determined so, the carriage 46 moves only for the time Tup. Therefore, a distance which it is necessary for the carriage 46 to move before the actual printing is performed by the drum 61 can be reduced to the above limit. This distance will be referred to as a run-up distance, hereinafter.

Further, in FIGS. 14B and 14C, because the actual printing operation is being performed, a moving speed of the carriage 46 is the same as the circumferential speed V (millimeters/second) of the drum 61. Therefore, if the carriage moving distance X2 is larger than RΘ (X2>RΘ), it is possible that the printing is performed within the recording paper sheet 44 and is not performed outside the recording paper sheet 44. However, if X2<RΘ, the printing may be performed outside the recording paper sheet 44. In order to prevent such a problematic situation, it is necessary that the distance X2 is RΘ+τ (X2=RΘ+τ) so as to obtain the right-end margin τ in the recording paper sheet 44.

As described above, the distance X2 between the center of the drum 61 and the mounting position of the sensor 100 used for detecting the right edge RE shown in FIG. 14B is determined from RΘ+τ. However, as described above, the printing starting position on the paper sheet 44 does not depend on the distance X1 shown in FIG. 14A. Further, as mentioned above, the printer can be miniaturized by shortening the distance X1 between the center of the drum 61 and the mounting position of the sensor 100 used for detecting the left edge LE. Instead of the single sensor 100 for detecting the left edge LE and right edge RE of the paper sheet 44, it is also possible to provide two sensors 100*a* (drawn by a broken line in FIG. 12B) and 100, the sensor 100*a* being used for detecting the left edge LE and the sensor 100 being used for detecting the right edge RE. In this case, the distance X1 is a distance between the drum 61 center and the sensor 100*a* while the distance X2 is a distance between the drum center and the sensor 100. Therefore, X1 may be different from X2. As mentioned above, the printer can be miniaturized by shortening the distance X1. Therefore, by determining a mounting position of the sensor 100*a* to a position nearer to the drum 61, X1 can be shortened and thus the printer can be miniaturized.

Further, the present invention is not limited to the above-described embodiments, and variations and modifications may be made without departing from the scope of the present invention.

What is claimed is:

1. An image forming apparatus comprising:

conveying means for conveying a recording sheet in a sheet conveying direction;

a carriage comprising:

a processing means including an image carrier which is rotated about a rotational axis parallel to said sheet conveying direction, said processing means forming a latent image on said image carrier by electrically charging and developing said latent image so as to produce a developed image;

fixing means for fixing said developed image onto said recording sheet;

a supporting member for rotatably supporting said processing means and said fixing means;

transfer means for transferring said developed image on said image carrier to said recording sheet as a result of inserting said recording sheet between said image carrier and said transfer means as said carriage moves on said recording sheet in a carriage moving direction;

moving means for moving said carriage in said carriage moving direction which is perpendicular to said sheet conveying direction: and a retreating mechanism for rotating said processing means and said fixing means so as to remove said image carrier and said fixing means from said transfer means, said retreating mechanism comprising:

driving means;

engaging means which is driven by said driving means and thus moves said image carrier and said fixing means, said engaging means comprising an eccentric cam, and transmission means for transmitting a driving force from said driving means to said eccentric cam.

2. The image forming apparatus according to claim 1, wherein:

at least said image carrier is rotated by said driving means so that a circumferential speed of said image carrier is the same as a speed in which said carriage moves in said carriage moving direction; and said image carrier is provided with selective transmitting means for selectively transmitting a driving force from said driving means to said image carrier.

3. The image forming apparatus according to claim 1, wherein said image carrier is rotated a predetermined rotation angle before said carriage moves from a printing starting position.

4. The image forming apparatus according to claim 1, wherein said image carrier is rotated at a speed, such that a circumferential speed thereof is the same as a speed in which said carriage moves in said carriage moving direction, before said fixing means fixes said developed image on said recording sheet.

5. An image forming apparatus comprising:

conveying means for conveying a recording sheet in a sheet conveying direction;

a carriage comprising:

processing means including an image carrier which is rotated about a rotational axis parallel to said sheet conveying direction, said processing means forming a latent image on said image carrier by electrically charging and developing said latent image using a developing member so as to produce a developed image;

transfer means for transferring said developed image on said image carrier to said recording sheet as a result of inserting said recording sheet between said image carrier and said transfer means as said carriage moves on said recording sheet in a carriage moving direction;

fixing means for fixing said developed image onto said recording sheet; a supporting member for rotatably supporting said processing means and said fixing means;

moving means for moving said carriage in said carriage moving direction which is perpendicular to said sheet conveying direction; and a retreating mechanism for rotating said processing means and said fixing means so as to remove said image carrier and said fixing means from said transfer means when said carriage reaches a predetermined position;

a reverse-bias voltage generator for applying a voltage having a polarity reverse to a polarity of a voltage of a charged developing substance to said developing member:

switching means for switching a polarity of the voltage applied by said reverse-bias voltage generator to said developing member, wherein a diameter of said image carrier is determined such that one rotation of said image carrier may result in printing of a maximum printing width of said recording sheet.

6. An image forming apparatus comprising:

conveying means for conveying a recording sheet in a sheet conveying direction;

a carriage comprising:

processing means including an image carrier which is rotated about a rotational axis parallel to said sheet conveying direction, said processing means forming a latent image on said image carrier by electrically charging and developing said latent image so as to produce a developed image;

fixing means for fixing said developed image onto said recording sheet; and a supporting member for rotatably supporting said processing means and said fixing means; and detecting means for detecting an edge of said recording sheet.

7. The image forming apparatus according to claim 6, wherein:

said detecting means is disposed in a carriage moving direction from said image carrier; and a circumferential distance between an exposure position and a transfer position on said image carrier is shorter than a distance between a center of said image carrier and a recording sheet ending edge measured when an exposure operation for printing one line of an image part has been completed.

8. The image forming apparatus according to claim 6, wherein movement of said carriage is stopped for a predetermined time after said detecting means has detected a recording sheet starting edge.

9. The image forming apparatus according to claim 6, wherein said detecting means is mounted on said supporting member.

10. The image forming apparatus according to claim 6, further comprising:

transfer means for transferring said developed image on said image carrier to said recording sheet as a result of inserting said recording sheet between said image carrier and said transfer means as said carriage moves on said recording sheet in a carriage moving direction;

moving means for moving said carriage in said carriage moving direction which is perpendicular to said sheet conveying direction; and a cleaning member, mounted in the proximity of said transfer means, for cleaning said detecting means as a result of coming into contact with said detecting means when said carriage moves.

* * * * *